US010701965B2

(12) United States Patent
Bao et al.

(10) Patent No.: US 10,701,965 B2
(45) Date of Patent: Jul. 7, 2020

(54) SYSTEMS, METHODS, AND DEVICES FOR DELIVERING TOBACCO INTO TOBACCO CASING TUBES

(71) Applicant: Fan Bao, Brea, CA (US)

(72) Inventors: Fan Bao, Brea, CA (US); Christopher Grant Smith, Culver City, CA (US); Jiandong Liu, Wenzhou (CN)

(73) Assignee: Fan Bao, Brea, CA (US)

( * ) Notice: Subject to any disclaimer, the term of this patent is extended or adjusted under 35 U.S.C. 154(b) by 140 days.

(21) Appl. No.: 15/818,627

(22) Filed: Nov. 20, 2017

(65) Prior Publication Data

US 2019/0150499 A1 May 23, 2019

(51) Int. Cl.

| | |
|---|---|
| ***A24C 5/02*** | (2006.01) |
| ***A24C 5/06*** | (2006.01) |
| ***A24C 5/42*** | (2006.01) |
| ***A24C 5/40*** | (2006.01) |
| ***A24C 5/39*** | (2006.01) |

(52) U.S. Cl.

CPC ..... *A24C 5/02* (2013.01); *A24C 5/06* (2013.01); *A24C 5/398* (2013.01); *A24C 5/40* (2013.01); *A24C 5/42* (2013.01); *A24C 5/425* (2013.01)

(58) Field of Classification Search

CPC .. A24C 5/398; A24C 5/40; A24C 5/42; A24C 5/06; A24C 5/425

USPC ..... 131/108

See application file for complete search history.

(56) References Cited

U.S. PATENT DOCUMENTS

| | | | | |
|---|---|---|---|---|
| 2,276,719 A * | 3/1942 | Daudelin | ..... | A24C 5/42 131/75 |
| 5,687,747 A * | 11/1997 | Schramm | ..... | A24C 5/06 131/108 |
| 8,261,752 B2 | 9/2012 | Bao | | |
| 2006/0096604 A1* | 5/2006 | Moser | ..... | A24C 5/42 131/70 |
| 2007/0107738 A1* | 5/2007 | Barnes | ..... | A24C 5/02 131/70 |
| 2015/0047654 A1* | 2/2015 | Thiry | ..... | A24C 5/06 131/70 |

* cited by examiner

*Primary Examiner* — Alex B Efta
(74) *Attorney, Agent, or Firm* — One LLP

(57) ABSTRACT

Systems, methods, and devices for automatically delivering tobacco into a tobacco receiving cavity in a cigarette casing, including a packer module with movable fingers for compressing tobacco.

25 Claims, 38 Drawing Sheets

SYSTEMS, METHODS, AND DEVICES FOR DELIVERING TOBACCO INTO TOBACCO CASING TUBES

CROSS-REFERENCE TO RELATED APPLICATIONS

The present application relates generally to apparatus, systems and methods for use with cigarette tobacco filling devices.

This application is related to the subject matter disclosed in U.S. Provisional Application No. 61/209,953 filed Mar. 9, 2009, titled "CIGARETTE TUBE INJECTOR"; U.S. Non-Provisional application Ser. No. 12/584,110 filed Aug. 31, 2009, titled "CRANK TYPE AUTOMATIC CIGARETTE TUBE INJECTOR"; U.S. Non-Provisional application Ser. No. 13/507,774 filed Jul. 26, 2012, titled "CRANK TYPE AUTOMATIC CIGARETTE TUBE INJECTOR"; U.S. Non-Provisional application Ser. No. 14/224,036 filed Mar. 24, 2014, titled "CIGARETTE TOBACCO FILLER DEVICE"; and U.S. Non-Provisional application Ser. No. 15/199,461 filed Jun. 30, 2016, titled "SYSTEMS, METHODS and APPARATUSES FOR ROTATIONAL DRIVE MODULES FOR USE WITH CIGARETTE TOBACCO FILLING DEVICES," which are hereby incorporated by reference in their entirety.

FIELD OF THE INVENTION

This invention is related to automatic cigarette tobacco filling systems, methods, and devices that are electrically powered.

BACKGROUND OF THE INVENTION

The cigarettes consumed by people are normally manufactured by factories and are sold in market. A cigarette is typically known to be a paper wrapped tube stuffed with finely cut tobacco leaves that may have a filter. Generally, the tobacco leaves are cured and processed with additives. There are many flavors and brands of premade cigarettes that people can purchase that have different types of tobacco leaves, which may undergo different cure processes and additives. However, some people wish to fill and smoke their own tobacco cigarettes, sometimes referred to as "roll your own" or "RYO" products.

For people that wish to fill and smoke their own tobacco cigarettes, there are different methods of preparation for the cigarettes. One is that they can be manually prepared by hand, by rolling a cigarette paper with cut tobacco leaves inside. Performing these functions by hand can require a significant amount of time and can be difficult for some individuals. Further, stuffing shredded tobacco leaves with a uniform and proper compactness can be a skill that requires a significant amount of practice. If the shredded tobacco leaves are too compressed, the cigarettes can be difficult to smoke. Alternatively, if the tobacco leaves are wrapped too loosely, the tobacco may fall out of the cigarette before or during a smoking session, or the burning end or "ash" of the cigarette may either extinguish or even fall off during a smoking session.

Another method of preparing cigarettes that people can perform on their own is through the use of a cigarette preparing machine. These usually comprise an injection device within a machine casing and an actuation device for actuating the injection device. The injection device typically comprises a plunger or "spoon" that is actuated by the actuation device and fills a predetermined amount of tobacco into an empty cigarette tube.

Currently there are machines that are commercially available that allow people to make cigarettes with their own tobacco. However, there are a number of problems that plague these existing machines. For example, a manual crank-type machine can be operated by a user filling shredded tobacco leaves into the crank nozzle, such that when the crank nozzle is inserted into the cigarette paper tube, the tobacco leaves are loaded therein. The advantage of the manual crank-type machine is that it reduces the amount of time required for users to prepare each cigarette, compared to hand rolling. However, a drawback of the manual crank-type machine is that the injection is not automatic or electrically powered. As such, the user must use both hands to provide force, alignment, and stability. Another drawback is that the tobacco leaves might not be evenly loaded within the cigarette paper tube, such that compactness of the resulting cigarette is not uniform.

Automatic cigarette rolling machines have also been created that are driven by electric power. These use motors to automatically inject tobacco leaves into cigarette tubes. One problem with these machines is that they can be large and heavy. Another problem is that tobacco leaves can be shredded into small pieces within the cigarette paper tube. Therefore, when the cigarette is lit, the cigarette ash cannot be held properly while smoking and will fall unexpectedly, causing a messy and potentially dangerous situation. In various embodiments, this is an issue with auger type machines. Additionally, these machines are prone to jamming. Further, these machines can be quite expensive Some attempts have been made at creating cigarette rolling machines, including in U.S. Patent Appl. Publ. No. 2006/0096604 to Moser and U.S. Patent Appl. Publ. No. 2015/0047654 to Thiry. These machines and other solutions proposed have been less than desirable because they are completely mechanical, measure compaction with a single sensor, include only a single compressor, lack proper agitation of tobacco prior to filling, and have been expensive.

There is therefore a need for improved methods, devices, and systems that allows users to easily, simply, effectively, and automatically insert tobacco into a cigarette paper tube.

SUMMARY

Provided herein are embodiments of cigarette tobacco filler devices, that are easy to operate and easily and efficiently fill a cigarette tube with tobacco. These machines allow for adjustment of the density of tobacco to be packed, can perform multiple packing operations in a row without needing constant replacement or maintenance, and quickly perform their operations. As such, the embodiments described herein are generally directed to an automatic cigarette making machines that fill cigarette tubes by interacting with user interface buttons that control electrically powered motors. Once a cigarette tube is placed on a nozzle and a start button is pressed, components in the machine operate to pack a preset amount of tobacco and insert it into a cigarette tube automatically.

Some embodiments described herein include multiple sensors that allow the machine to monitor packing operations more effectively than prior art machines. Additionally, some embodiments described herein include multiple structures that contact tobacco and provide packing operation, which can be more effective than single packing components of prior machines.

Advantages of these embodiments provide include time savings for users over manual or existing automatic cigarette making machines. Additionally, the machines described herein can operate more quickly than prior machines. Also, these machines allow for greater control of tobacco packing (including packing density), and thus more variability. Further, they are less expensive than previous automatic machines. Those in the art will also understand that this list of advantages is not comprehensive and there are additional advantages that are not listed, which will be evident in reviewing the figures and description provided herein.

In some embodiments, the machines and methods disclosed herein make quality cigarettes unlike those that can otherwise be made by individuals at home. As such, they may be more like those that would be expected from a professional manufacturer. These can be created using the embodiments described herein with a minimal or no learning curve. To elaborate, in some embodiments, this can be accomplished without the learning curve of having to "get the feel" of how to pack tobacco or having to rely on any pre-treatment of the tobacco, such as chopping it up finely or otherwise. The machines and methods described herein have been designed to replicate, duplicate, or otherwise enhance the dexterity that would be expected from human fingers when packing the tobacco into a chamber or cigarette tube. As such, using or otherwise employing the machines or methods herein, users may relax and push a button instead of having to worry about whether they have packed their cigarettes too tight or too loose.

As will be understood, various improvements over prior machines included herein provide that the embodiments herein include machines that make high quality cigarettes, as would be expected from those made by mass-manufacturing companies. These can be created without or with minimal learning curves for getting the "feel" of how to pack the tobacco into the cigarette tubes. Further, they can be created without or with minimal pre-treatment of the tobacco, such as chopping it into fine amounts. These machines and methods have been designed and implemented to replicate, duplicate, or otherwise simulate the dexterity of human fingers in packing the tobacco into a tobacco packing chamber and then into cigarette tubes. With these embodiments the user may relax and simply push a button, instead of worrying about whether they have packed the tobacco in their cigarettes too tight or too loose.

Other systems, devices, methods, features, objectives and advantages of the subject matter described herein will be or will become apparent to one with skill in the art upon examination of the following figures and detailed description. It is intended that all such additional devices, methods, features and advantages be included within this description, be within the scope of the subject matter described herein, and be protected by the accompanying claims. In no way should the features of the example embodiments be construed as limiting the appended claims, absent express recitation of those features in the claims.

BRIEF DESCRIPTION OF THE DRAWING(S)

The details of the subject matter set forth herein, both as to its structure and operation, may be apparent by study of the accompanying figures, in which like reference numerals refer to like parts. The components in the figures are not necessarily to scale, emphasis instead being placed upon illustrating the principles of the subject matter. Moreover, all illustrations are intended to convey concepts, where relative sizes, shapes and other detailed attributes may be illustrated schematically rather than literally or precisely.

Illustrated in the accompanying drawing(s) is at least one of the best mode embodiments of the present invention. In such drawing(s):

DETAILED DESCRIPTION

Before the present subject matter is described in detail, it is to be understood that this disclosure is not limited to the particular embodiments described, as such may vary. It should also be understood that the terminology used herein is for the purpose of describing particular embodiments only and is not intended to be limiting, since the scope of the present disclosure will be limited only by the appended claims.

A conventional cigarette making machine generally comprises an injection device for tobacco that is received in a cigarette casing, including a manually operated actuation component, device, or module for actuating the injection device. The injection device comprises a plunger being actuated by the actuation device for filling a predetermined amount of tobacco into an empty cigarette tube casing. FIGS. 1-7 show an example embodiment of a prior art manually operated cigarette making machine that will be briefly described to illustrate operation and functionality. FIGS. 8-18 show example embodiments diagrams and images of various aspects and features of electronic cigarette filling machines that perform operations to automatically fill cigarette tubes according to the present disclosure.

Figure 1:
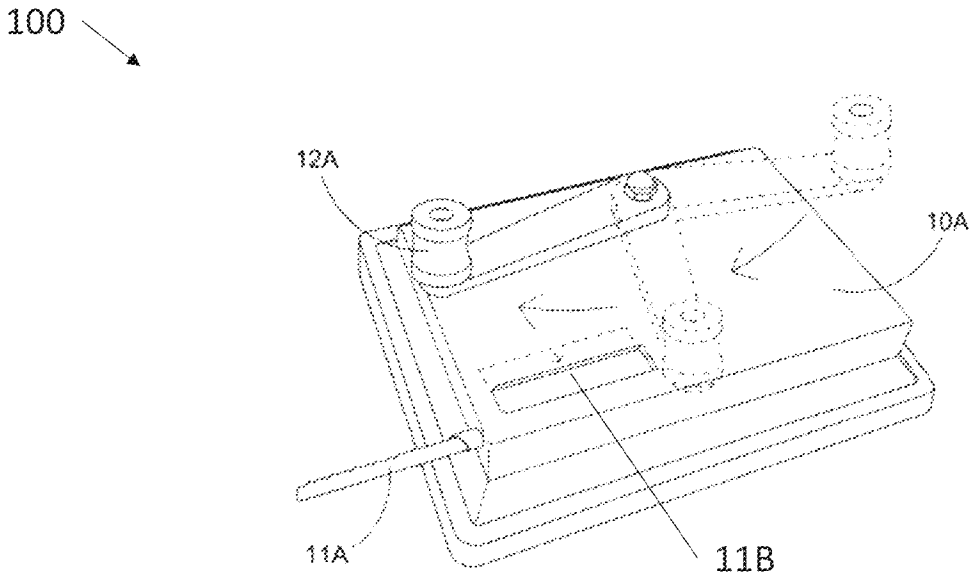
FIG. 1 PRIOR ART
FIG. 1 is an example embodiment of a perspective view of a conventional cigarette making machine, illustrating a rotatable handle being rotated above the top side of a casing, thereby extending a plunger.

FIG. 1 is an example embodiment of a perspective view of a conventional prior art cigarette making machine 100, illustrating a rotatable handle 12A being rotated above the top side of a casing 10A, thereby extending a plunger 11A.

Figure 2A:
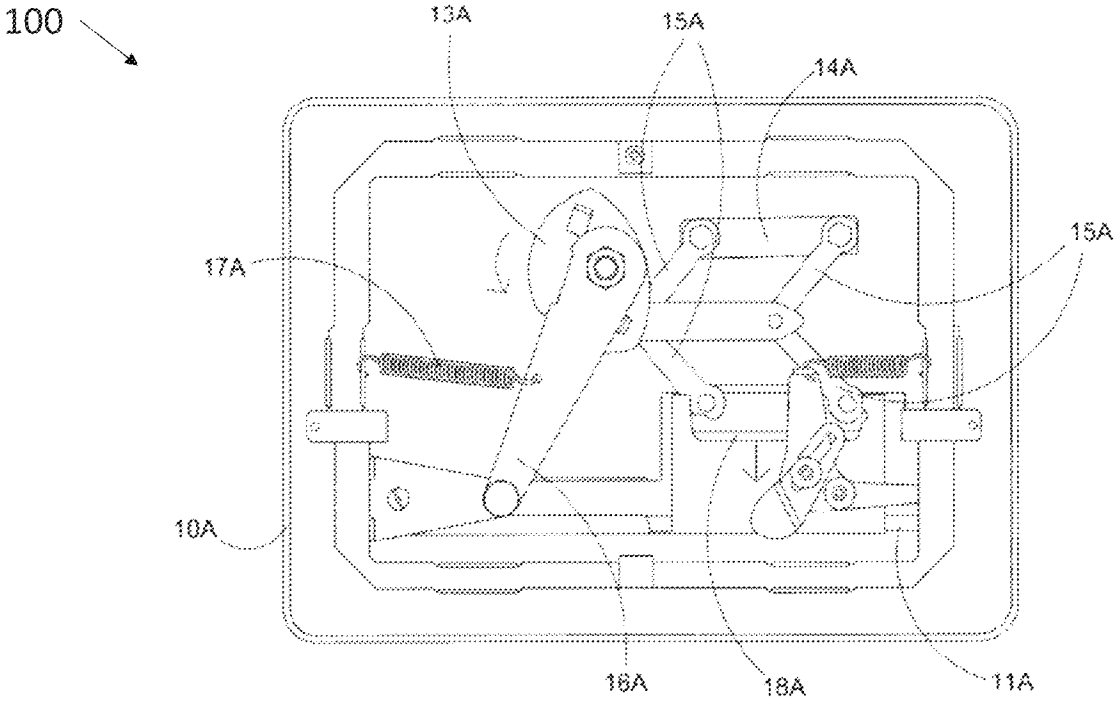
FIG.2A PRIOR ART
FIGS. 2A to 2C illustrate an example embodiment of an operation of the conventional cigarette making machine from a cutaway bottom view.
Figure 2B:
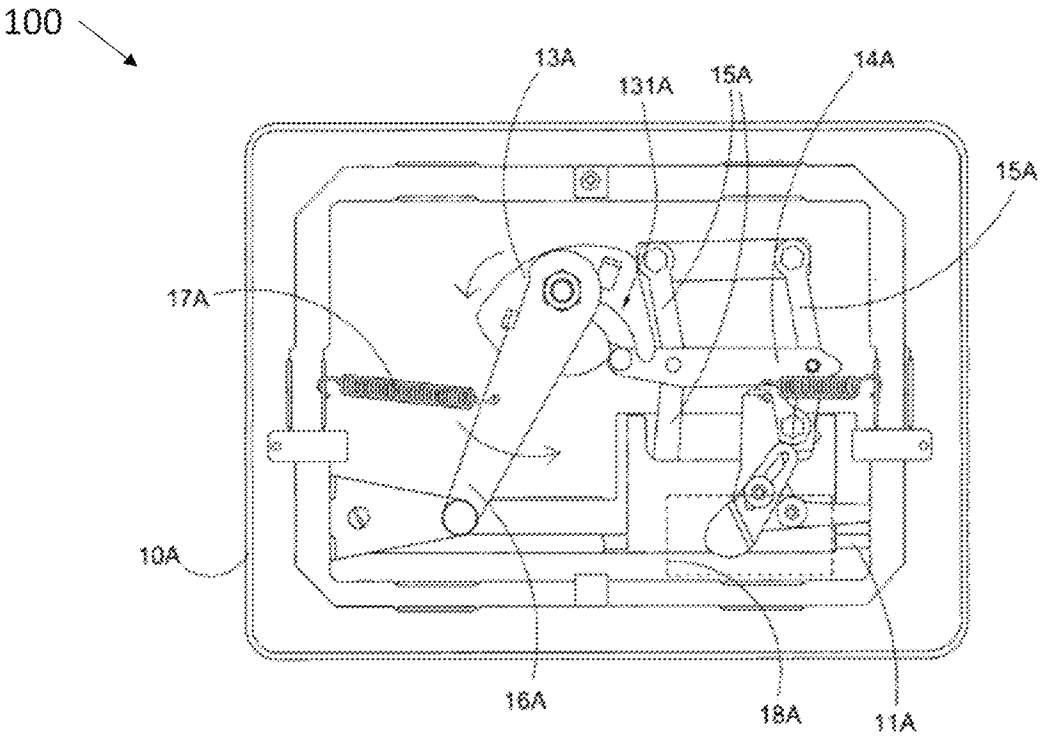
FIG.2B PRIOR ART
Figure 2C:
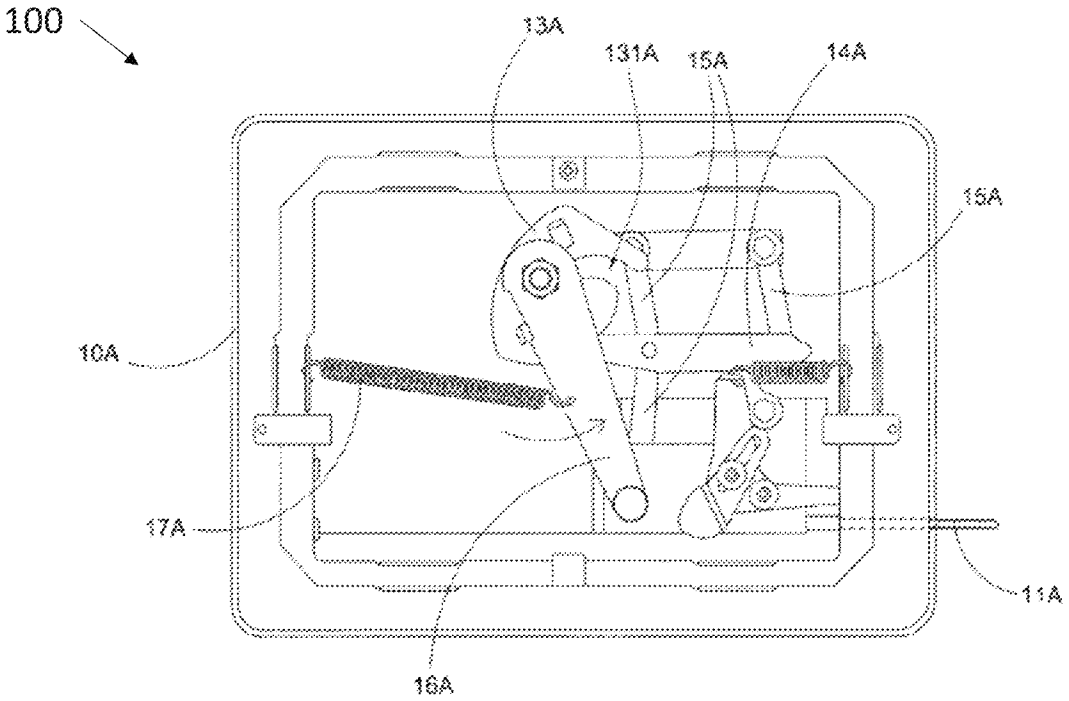
FIG.2C PRIOR ART

FIGS. 2A to 2C illustrate an example embodiment of an operation of the conventional prior art cigarette making machine 100, from a cutaway bottom view. As shown in the example embodiment, cigarette making machine 100 includes an opening of a tobacco receiving chamber or cavity 11B for receiving a sufficient amount of tobacco to fill a cigarette casing provided on a top side of casing 10A. Casing 10A can enclose internal components of an injection device, wherein when a plunger 11A is actuated, it pushes tobacco contained in tobacco receiving chamber 11B into an open end of a cigarette tube. In particular, window 18A can be provided at the top side of casing 10A and can be actuated, for instance by cranking handle 12A, whereby the actuation device closes the tobacco receiving chamber 11B. Window 18A can have a sharp cutting edge arranged in such a manner that when window 18A is moved to close tobacco receiving chamber 11B, the cutting edge of window 18A is moved and can cut any excessive amount of tobacco out of or otherwise away from tobacco receiving chamber 11B so as to retain a sufficient amount of tobacco therein, to fill a single cigarette tube.

The actuation device can include a number of mechanically coupled components, including rotatable handle 12A, which can be rotatably coupled on a top side of the casing 10A. The actuation device can also include an actuation link between rotatable handle 12A and plunger 11A, as shown in FIG. 2A. Rotatable handle 12A is rotated above the top side of casing 10A about a central point in a single plane in two directions, in order to provide dual action operation, as shown in FIG. 1. In other words, rotatable handle 12A is rotated to actuate window 18A for closing tobacco receiving chamber 11B first and then serves to actuate plunger 11A to push the tobacco into the cigarette tube. The actuation device can also include a cam 13A driven by the rotatable handle 12A, a window link connected between cam 13A and window 18A, and a plunger link connected between cam 13A and plunger 11A. The window link can include a transverse link 14A and a plurality of longitudinal links 15A. The plunger link can include a plunger actuation arm 16A connected to plunger 11A.

Rotatable handle 12A can be manually rotated by a user, resulting in a corresponding rotary movement in an axle and integrally attached cam 13A, wherein the rotary movement of cam 13A urges transverse link 14A to move. The longitudinal links 15A can be rotatably pivoted at one end to the transverse link 14A to actuate window 18A for closing the tobacco receiving chamber, as shown in FIG. 2B.

Once window 18A is actuated to close tobacco receiving chamber 11B, the rotatable handle 12A can be further rotated in order to actuate the plunger actuation arm 16A. The rotatable movement of the plunger actuation arm 16A can be transmitted to move plunger 11A in a linear movement. A compression spring 17A can be coupled to plunger actuation arm 16A to pull plunger actuation arm 16A back to its original position, so as to move plunger 11A back in a linear movement.

Referring to FIGS. 3A-3C and FIGS. 4-7, a conventional prior art cigarette tobacco filler device according to an example embodiment is illustrated, wherein the cigarette tobacco filler device, which is arranged for filling a predetermined amount of tobacco into an empty cigarette tube, include a casing 10, an injection unit 20 and a plunger actuation unit 30.

Casing 10 can have a tobacco receiving cavity 11 provided at a top side of casing 10 for receiving tobacco, and an outlet 12 provided at a front side of casing 10 for holding a cigarette tube in position, wherein outlet 12 is in communication with the tobacco receiving cavity 11. Outlet 12 can have a tubular structure having a circumferential size slightly smaller than the circumferential size such that the outlet 12 is adapted for inserting into the opening end of the cigarette tube to hold the cigarette tube in position. Casing 10 can further have a sloping platform 13 provided at the top side of casing 10 to align with the top opening of tobacco receiving cavity 11, wherein sloping platform 13 is downwardly extended to tobacco receiving cavity 11 such that a user is able to brush tobacco at sloping platform 13 into tobacco receiving cavity 11. Casing 10 further includes a handle bar 14 spacedly extended above the top side of casing 10 and extended between the front and rear sides of casing 10 for carrying purposes and steadying the device while in use. Casing 10 can further have or enclose an interior cavity for receiving injection unit 20 and plunger actuation unit 30, such that a bottom panel 15 can be coupled at the bottom side of casing 10 to enclose the interior cavity.

Injection unit 20 can comprise a plunger 21 movably supported in casing 10 at a position that a front pushing end 211 of plunger 21 is moved forward through tobacco receiving cavity 11 to outlet 12 for delivering or otherwise pushing the tobacco into the cigarette tube. Accordingly, plunger 21 can have an elongated structure and be slid or otherwise moved in casing 10 in a longitudinal direction within casing 10. In particular, plunger 21 can be coaxially aligned with outlet 12, such that when the plunger 21 is moved forward in a linear manner, front pushing end 211 of plunger 21 will push the tobacco contained within tobacco receiving cavity 11 into the cigarette tube through outlet 12.

Injection unit 20 can further include a linear guiding channel 22 longitudinally formed within casing 10 to guide the longitudinal movement of plunger 21. Accordingly, injection unit 20 can include two elongated plunger guiding arms 23 defining the sides of guiding channel 22 therebetween, wherein plunger 21 is slidably coupled between plunger guiding arms 23 along guiding channel 22 to ensure plunger 21 is being moved longitudinally, without angular deviation.

Plunger actuation unit 30 can include a power shaft 31 rotatably supported in casing 10 to couple with plunger 21 and an operation handle 32 pivotally extended above the top side of the casing 10, wherein when operation handle 32 can be pivotally moved down toward the top side of casing 10, such that power shaft 31 is driven to rotate. Accordingly, power shaft 31 can provide a rotatable power to actuate plunger 21 for inserting tobacco contained within tobacco receiving cavity 11 into the cigarette tube through outlet 12. When operation handle 32 is pivotally moved up and away from the top side of casing 10, power shaft 31 can be driven to rotate in an opposite direction, wherein plunger 21 can move backward in a linear manner so as to move back to its original position.

Power shaft 31 can be the main power transmitting element for transmitting the rotatable power from the operation handle 32. One end of the power shaft 31 can be coupled with the bottom end of operation handle 32 such that when the upper end of operation handle 32 is pivotally moved down toward the top side of casing 10, power shaft 31 can be driven to rotate for generating the rotatable power. Accordingly, plunger 21 and power shaft 31 are spacedly supported within casing 10 and are extended parallel to each other.

In various embodiments, a user is able to apply a downward force at operation handle 32 to drive operation handle 32, thereby pivotally moving it down toward the top side of casing 10. The pivotally downward movement of operation handle 32 allows the user to easily operate operation handle 32 in an ergonomically actuating manner for completing the filling of tobacco into the cigarette tube. In other words, the pivotally downward movement of operation handle 32 is designed to optimize how the force applied by the user and to enhance the overall device performance.

By applying the downward force, casing 10 will be stably rested on a surface, such as a table surface, so as to prevent any unwanted movement of casing 10 during the operation of the cigarette tobacco filler device. In some embodiments, operation handle 32 is coupled at a rear side of casing 10 to maximize the distance between operation handle 32 and outlet 12 for easy operation.

According to some embodiments, the plunger actuation unit 30 further comprises a gear unit 33 driven by the power shaft 31 and an actuation arm 34 for actuating the plunger 21. The actuation arm 34 has a pivot end operatively coupled with the gear unit 33 and a driving end operatively coupled with the plunger 21 in such a manner that when the power shaft 31 is driven to rotate, the actuation arm 34 is pivotally moved to longitudinally move the plunger 21 forward for pushing the tobacco to the outlet 12. In some embodiments, there may be no gears, but rather one or more double lever actuators. This may be a horizontally mounted lever pushes a vertically mounted lever.

As shown in FIGS. 4-7, the actuation arm 34 comprises a first arm member 341 pivotally coupled with the gear unit 33 and a second arm member 342 pivotally coupled at the rear end of the plunger 21, wherein the first and second arm members 341, 342 are pivotally coupled with each other in an end-to-end manner. Accordingly, the pivot end of the actuation arm 34 is defined at the first arm member 341 to pivotally couple with the gear unit 33 while the driving end of the actuation arm 34 is defined at the second arm member 342 to couple at the rear end of the plunger 21.

Therefore, when the first arm member 341 is pivotally moved to the front side of the casing 10, the second arm member 342 is driven to longitudinally move the plunger 21 forward. When the first arm member 341 is pivotally moved back to the rear side of the casing 10, the second arm member 342 is driven to longitudinally move the plunger 21 backward.

The gear unit 33 is arranged to transmit the rotatable power from the power shaft 31 to a pivotal movement of the actuation arm 34. In particular, the gear unit 33 comprises a first gear 331 coaxially coupled at the power shaft 31 and a second gear 332 which is coupled at the pivot end of the actuation arm 34 and is operatively engaged with the first gear 331. In particular, the second gear 332 will also transmit the direction of the rotatable power from the first gear 331 to the actuation arm 34.

The first gear 331 has a teething edge portion and a non-teething edge portion provided at the circumferential edge of the first gear 331. The second gear 332 has a teeth edge portion to selectively engage with the teething edge portion and the non-teething edge portion of the first gear 331 when the first gear 331 is rotated. Accordingly, when the first gear 331 is rotated at a position that the non-teething edge portion of the first gear 331 is engaged with the second gear 332, the second gear 332 is idle such that the actuation arm 34 is remained at a motionless manner. When the first gear 331 is rotated at a position that the teething edge portion of the first gear 331 is engaged with the second gear 332, the second gear 332 is driven to rotate to pivotally move the actuation arm 34 so as to longitudinally move the plunger 21 forward.

The non-teething edge portion of the first gear 331 is initially engaged with the second gear 332. When the operation handle 32 is pivotally moved downward, the teething edge portion of the first gear 331 will then be engaged with the second gear 332. Therefore, the second gear 332 will be in an idle position at the first pivotal moving path of the operation handle 32. In addition, the curvature length of the teething edge portion of the first gear 331 is long enough to drive the plunger 21 to longitudinally move by the actuation arm 34 for inserting the tobacco into the cigarette tube.

In some embodiments where a mechanism has gears, the gears may always be engaged to each other. However, in some embodiments, one or more of the gears may be driven by a pin that rotates freely until a particular point before driving one or more of the gears.

As shown in FIGS. 3-7, the plunger actuation unit 30 further comprises a resilient element 35 coupled at the actuation arm 34 for applying an urging force thereagainst so as to longitudinally move the plunger 21 backward. Accordingly, the resilient element 35 comprises a coil spring for urging the actuation arm 34. In particular, the coil spring of the resilient element 35 has a coil portion coaxially coupled at the pivot end of the actuation arm 34 and two spring arms spacedly extended from the coil portion to bias against an inner wall of the casing 10 and the actuation arm 34 respectively. Accordingly, the respective spring arm of the resilient element 35 is coupled at the actuation arm 34 between the pivot end and the driving end. In particular, the respective spring arm of the resilient element 35 is coupled at the first arm member 341. The coil spring has a spring property to move the actuation arm 34 is a pivotally movable manner. Therefore, the fatigue life of the coil spring incorporating with the actuation arm will be substantially prolonged to extend the service life span of the resilient element 35.

Figure 5:
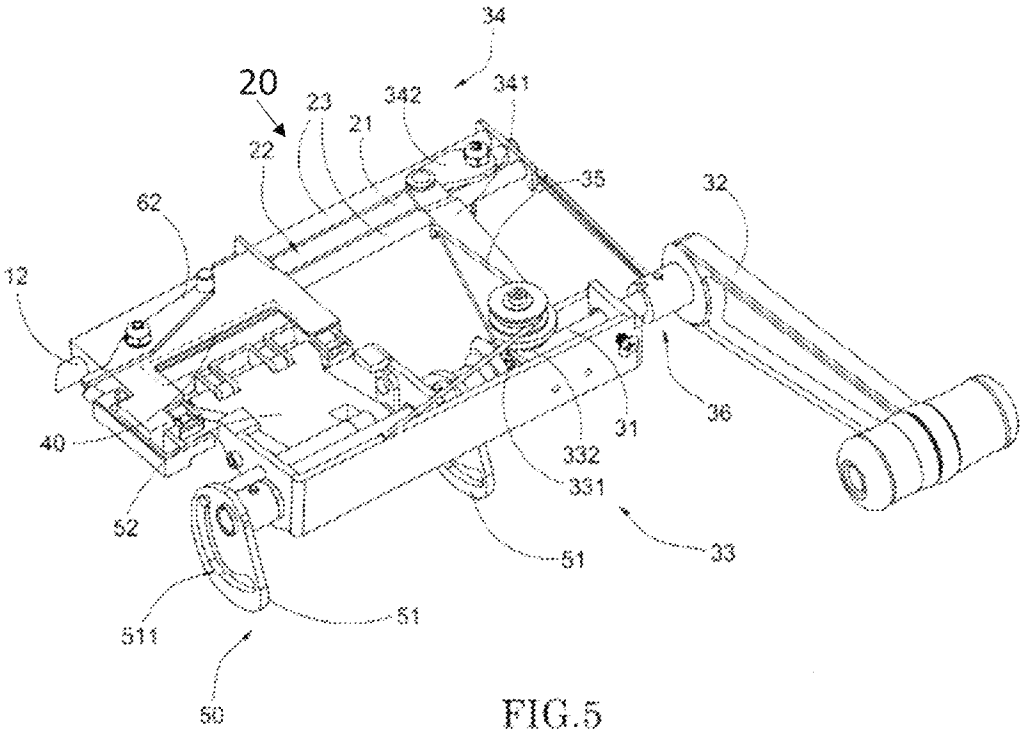
FIG.5 PRIOR ART
FIG. 5 is an example embodiment of a perspective view of a conventional cigarette tobacco filler device, illustrating a normal first position of the device.

According to the example embodiment, the cigarette tobacco filler device further comprises an enclosing window 40 movably coupled at the casing 10 to enclose the tobacco receiving cavity 11 thereof. Accordingly, the enclosing window 40 has a planar structure and is transversely moved to close the tobacco receiving cavity 11. In particular, the enclosing window 40 is movably coupled at the interior of the top side of the casing 10 such that when the top opening of the tobacco receiving cavity 11 is closed by the enclosing window 40, the tobacco receiving cavity 11 will house a predetermined amount of the tobacco in order to insert the tobacco into the cigarette tube. The tobacco receiving cavity 11 is normally closed by the enclosing window 40 to prevent the dust and particles entering into the tobacco receiving cavity 11 when the cigarette tobacco filler device is not in use, as shown in FIG. 5.

Figure 6:
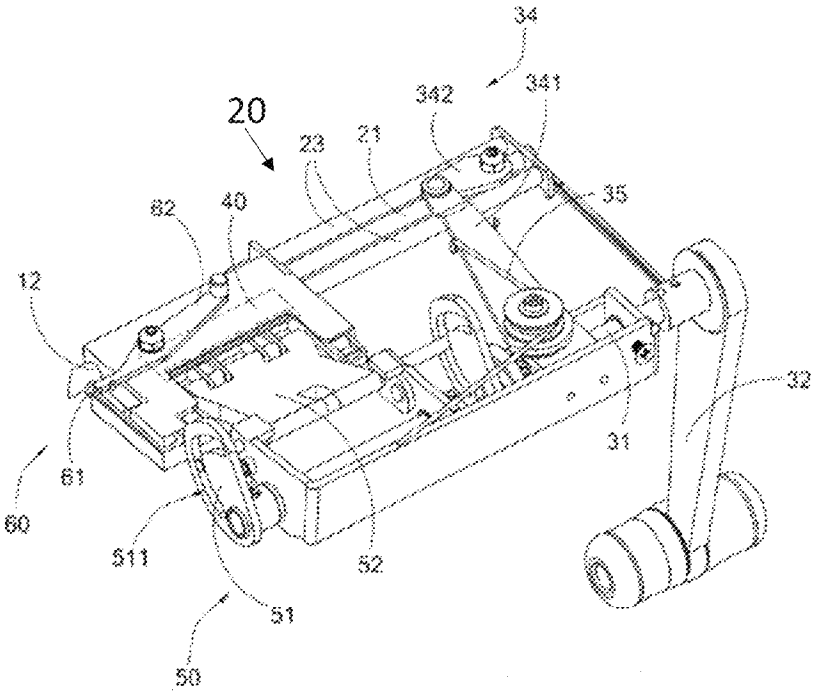
FIG.6 PRIOR ART
FIG. 6 is an example embodiment of a perspective view of a conventional cigarette tobacco filler device, illustrating a second position of the device to close a tobacco receiving cavity.
Figure 7:
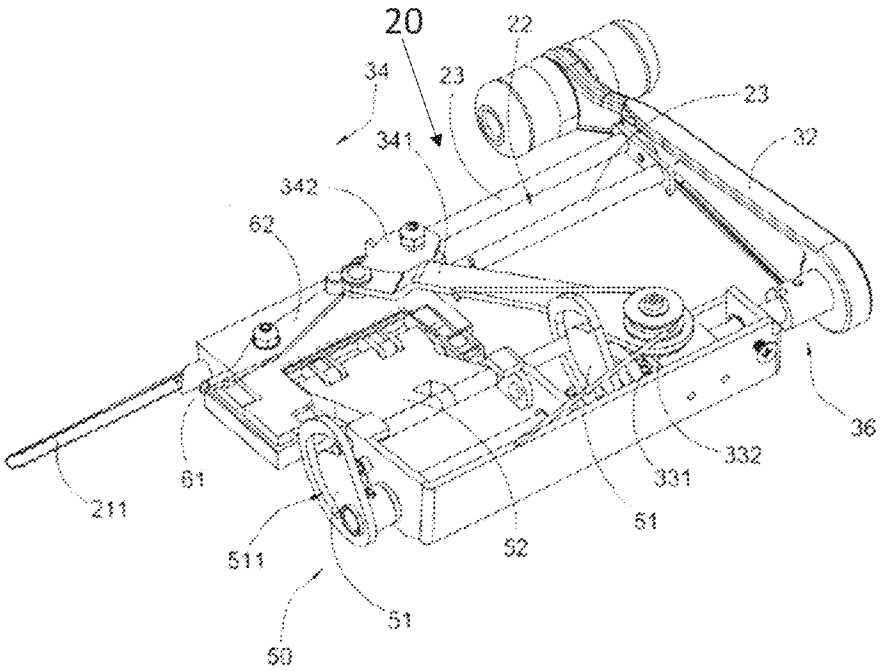
FIG.7 PRIOR ART
FIG. 7 is an example embodiment of a perspective view of a conventional cigarette tobacco filler device, illustrating a third position of the device to actuate a plunger.

The cigarette tobacco filler device further comprises a window actuation unit 50 operatively coupled between the enclosing window 40 and the power shaft 31, wherein when the power shaft 31 is rotated, the enclosing window 40 is moved by the window actuation unit 50 to enclose the tobacco receiving cavity 11 before the plunger 21 is moved. In particular, the window actuation unit 50 is actuated by the power shaft 31 when the non-teething edge portion of the first gear 331 is initially engaged with the second gear 332. Therefore, the enclosing window 40 is actuated to close the tobacco receiving cavity 11 before the actuation of the plunger 21, as shown in FIG. 6. In other words, the operation handle 32 provides dual actions to actuate both the enclosing window 40 and the plunger 21 subsequently in one single pivotally moving down movement. As such, at the first pivotal moving path of the operation handle 32, i.e. the non-teething edge portion of the first gear 331 is initially engaged with the second gear 332, the enclosing window 40 is actuated to close the tobacco receiving cavity 11. At the second pivotal moving path of the operation handle 32, i.e. the teething edge portion of the first gear 331 is then engaged with the second gear 332, the plunger 21 is actuated to insert the tobacco into the cigarette tube. The first and second pivotal moving paths of the operation handle 32 are continuous movement of the operation handle 32 to pivotally and downwardly move the operation handle 32 toward the top side of the casing 10.

Accordingly, the window actuation unit 50 comprises two swinging members 51 spacedly coupled with the power shaft 31 and a guiding panel 52 being driven to transversely shift by the swinging members 51. The swinging members 51 are identical and are securely coupled at the power shaft 31, wherein the swinging members 51 are rotatably swung when the power shaft 31 is rotated.

The guiding panel 52 has a first edge movably coupled between the swinging members 51 and an opposed second edge pivotally coupled with the enclosing window 40 in such a manner that when the power shaft 31 is rotated, the swinging members 51 are rotated to transversely shift the guiding panel 52 so as to transversely move the enclosing window 40 for closing the tobacco receiving cavity 11. In particular, each of the swinging members 51 has an arc-shaped guiding slot 511 that the first edge of the guiding panel 52 is engaged between the guiding slots 511 of the swinging members 51, such that when the swinging members 51 are driven to swing, the first edge of the guiding panel 52 is guided to slide therealong. In other words, when the swinging members 51 are driven to rotate by the power shaft 31, the first edge of the guiding panel 52 is guided to slide along the guiding slots 511 to transversely shift the guiding panel 52.

Figure 4:
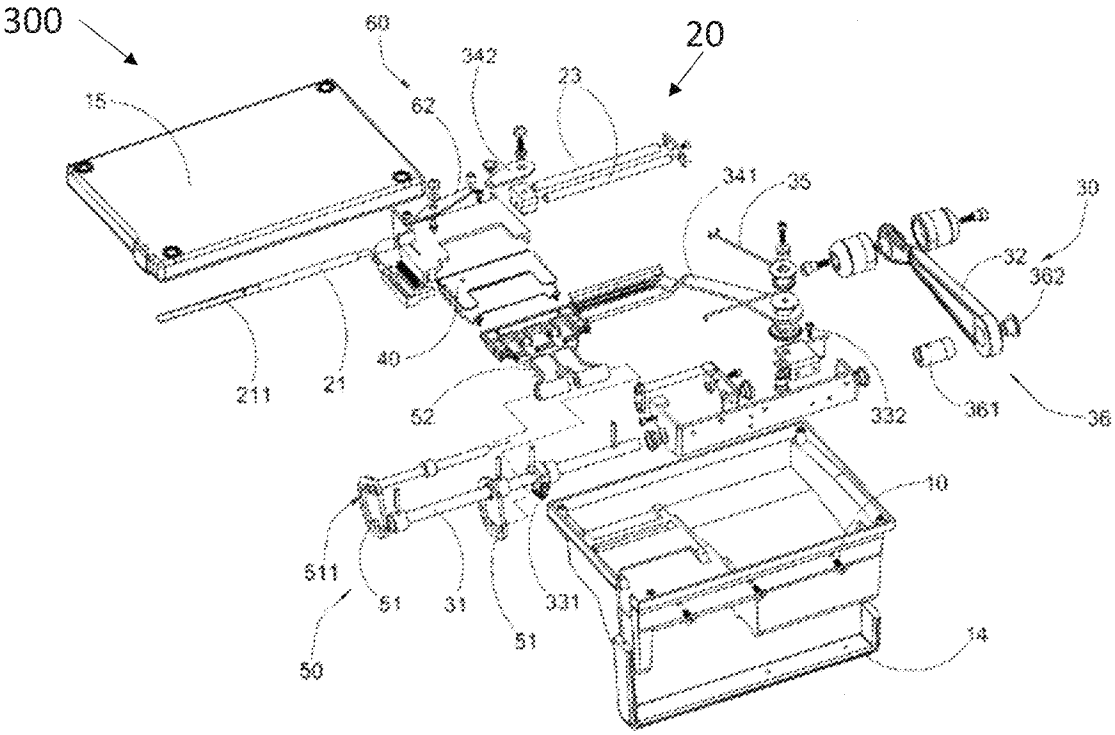
FIG.4 PRIOR ART
FIG. 4 is an example embodiment of an exploded perspective view of a conventional cigarette tobacco filler device.

As shown in FIG. 4, the first edge of the guiding panel 52 is engaged with the guiding slots 511 of the swinging members 51 via an elongated swing shaft. In addition, the guiding panel 52 is transversely shifted that when the first edge of the guiding panel 52 is moved downwardly along the guiding slots 511, the second edge of the guiding panel 52 is transversely moved toward the closing direction of the enclosing window 40. When the first edge of the guiding panel 52 is moved upwardly along the guiding slots 511, the second edge of the guiding panel 52 is transversely moved toward the opening direction of the enclosing window 40.

In various embodiments, one or more components of actuation unit 50, such as guiding slots 511 and swinging members 51 can be complemented, supplemented or replaced with other functional drive modules. In many embodiments, drive modules can be rotational drive modules or function differently but using similar principles.

The enclosing window 40 has a pivot edge pivotally coupled with the second edge of the guiding panel 52 via a hinge structure such that when the guiding panel 52 is transversely shifted, the enclosing window 40 is pushed to close the tobacco receiving cavity 11. The enclosing window 40 further has an opposed sharp cutting edge arranged in such a manner that when the enclosing window 40 is transversely moved to close the tobacco receiving cavity 11, the cutting edge is stably moved for cutting excessive amount of the tobacco out of the tobacco receiving cavity 11, so as to retain a predetermined amount of the tobacco in the tobacco receiving cavity 11. The swinging members 51 are concurrently swung about the power shaft 31 to generate an even pushing force toward the guiding panel 52. Therefore, the pushing force from the guiding panel 52 is evenly applied at the pivot edge of the enclosing window 40, such that the enclosing window 40 can be smoothly moved in a well balancing manner.

The prior art cigarette tobacco filler device further comprises a cigarette tube hold-and-release unit 60 for holding the cigarette tube at the outlet 12 and for releasing the cigarette tube from the outlet 12 after the tobacco is filled in the cigarette tube. Accordingly, the cigarette tube hold-and-release unit 60 comprises a tube holding member 61 movably biasing against the outlet 12 for holding the cigarette tube thereat, wherein the tube holding member 61, which is a spring-loaded member, has a holding face for applying a spring holding force at the outer surface of the outlet 12 so as to hold the cigarette tube in position. In particular, the tube holding member 61 is coupled with the enclosing window 40, wherein when the enclosing window 40 is at the opened position, the tube holding member 61 is moved away from the outlet 12 to define a gap between the holding face of the tube holding member 61 and the outer surface of the outlet 12 for the cigarette tube coupling with the outlet 12. When the enclosing window 40 is moved to its closed position, the tube holding member 61 is moved towards until the holding face of the tube holding member 61 is biased against the outer surface of the outlet 12 so as to hold the cigarette tube in position. In other words, the operation handle 32 not only actuates the enclosing window 40 but also actuates the tube holding member 61 at the same time.

The cigarette tube hold-and-release unit 60 further comprises a tube releasing arm 62 which is pivotally supported in the casing 10 and is actuated by the actuation arm 34. The tube releasing arm 62 has a releasing end engaging with the tube holding member 61 and an opposed control end arranged in such a manner that after the actuation arm 34 is moved to actuate the plunger 21 for inserting the tobacco into the cigarette tube, the control end of the tube releasing arm 62 is actuated by the actuation arm 34. Therefore, the releasing end of the tube releasing arm 62 is pivotally moved to move the tube holding member 61 away from the outlet 12 for releasing the cigarette tube from the outlet 12. When the front pushing end 211 of the plunger 21 is moved out of the outlet 12 for inserting the tobacco into the cigarette tube, the tube holding member 61 is moved away from the outlet 12 at the same time. Therefore, the plunger 21 will also push the cigarette tube to detach from the outlet 12 after the tobacco is filled in the cigarette tube.

The operation handle 32 further provides triple actions to actuate all the enclosing window 40, the plunger 21, and the cigarette tube hold-and-release unit 60 subsequently in one single pivotally moving down movement. As mentioned previously, the first pivotal moving path of the operation handle 32 is to actuate the enclosing window 40 is actuated to close the tobacco receiving cavity 11. The second pivotal moving path of the operation handle 32 is to actuate the plunger 21 is actuated to insert the tobacco into the cigarette tube. The operation handle 32 further provides a third pivotal moving path to actuate the cigarette tube hold-and-release unit 60 to release the cigarette tube from the outlet 12. The first, second, and third pivotal moving paths of the operation handle 32 are continuous movement of the operation handle 32 to pivotally and downwardly move the operation handle 32 toward the top side of the casing 10.

According to the example embodiment, the plunger actuation unit 30 further comprises a releasable joint 36 for releasing an engagement between the operation handle 32 and the power shaft 31. Accordingly, all the actuations are powered by the rotation of the power shaft 31. Once the power shaft 31 is in an idle state, all the components cannot be moved correspondingly. The releasable joint 36 is configured as safety device to ensure all the components are at the idle state when the cigarette tobacco filler device is not intentionally used.

The releasable joint 36 comprises a lock sleeve 361 coupled between the operation handle 32 and the power shaft 31 and a releasable lock 362 releasably engaged with the lock sleeve 361 to lock up the operation handle 32 with the power shaft 31. Therefore, when the releasable lock 362 is engaged with the lock sleeve 361, the operation handle 32 can be moved to drive the power shaft 31 to rotate. Likewise, when the releasable lock 362 is disengaged with the lock sleeve 361, the operation handle 32 is freely moved to idle the power shaft 31. When releasable lock 362 is disengaged with the lock sleeve 361, the operation handle 32 will not be totally detached from the power shaft 31. In particular, the operation handle 32 will only be freely rotated without driving the power shaft 31 to rotate. Therefore, when the device is not in use, the tobacco receiving cavity 11 can be enclosed by moving the operation handle 32 to close the tobacco receiving cavity 11 by the enclosing window 40 and by locking the operation handle 32 at the position to retain the enclosing window 40 at the closed position so as to prevent dust or other particles being accumulated in the tobacco receiving cavity 11.

The releasable joint 36 can incorporate with a magnetic alignment unit to align the actuation position of the operation handle 32 with respect to the power shaft 31. In other words, when the releasable lock 362 is re-engaged with the lock sleeve 361, an angular position of the operation handle 32 can be automatically aligned with the power shaft 31 via the magnetic alignment unit before the operation handle 32 is secured to the power shaft 31.

Figure 3A:
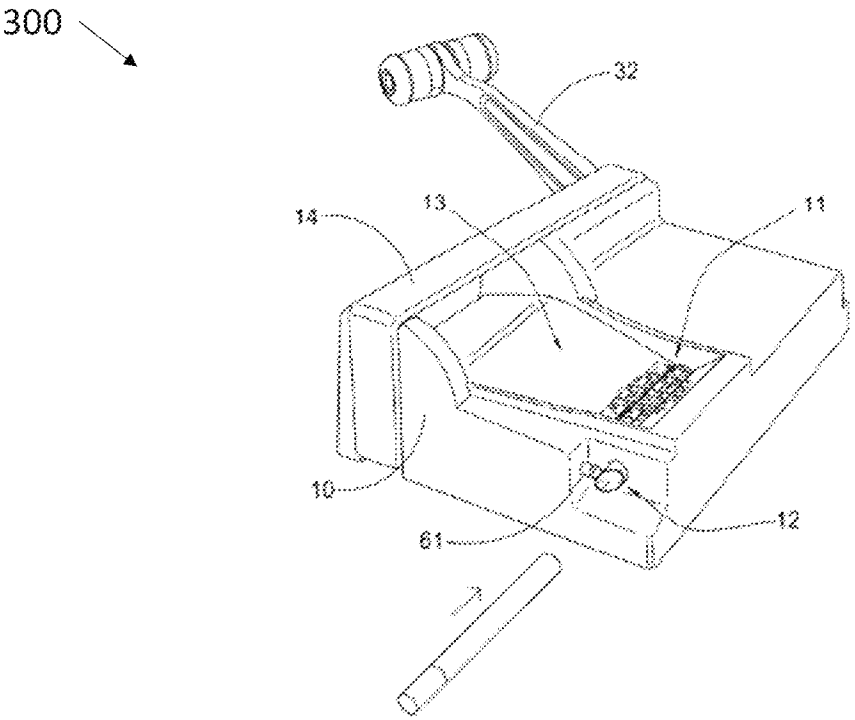
FIG.3A PRIOR ART
FIG. 3A is an example embodiment of a perspective view of a conventional cigarette tobacco filler device, illustrating the operation handle at an initial position for being pivotally and downwardly moved for actuation.
Figure 3B:
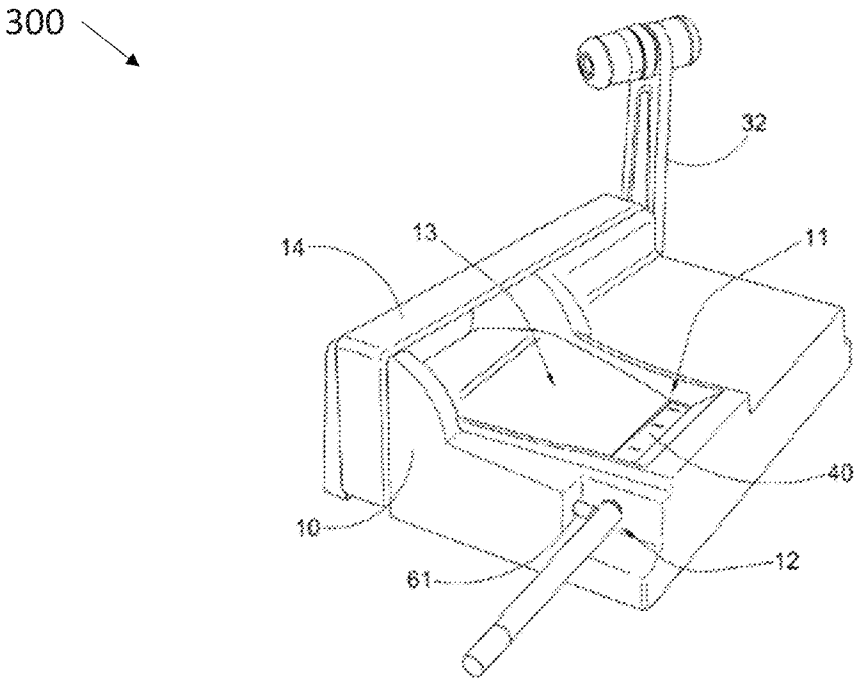
FIG.3B PRIOR ART
FIG. 3B is an example embodiment of a perspective view of a conventional cigarette tobacco filler device, illustrating the operation handle at a second position for being pivotally and downwardly moved for actuation of the enclosing window.
Figure 3C:
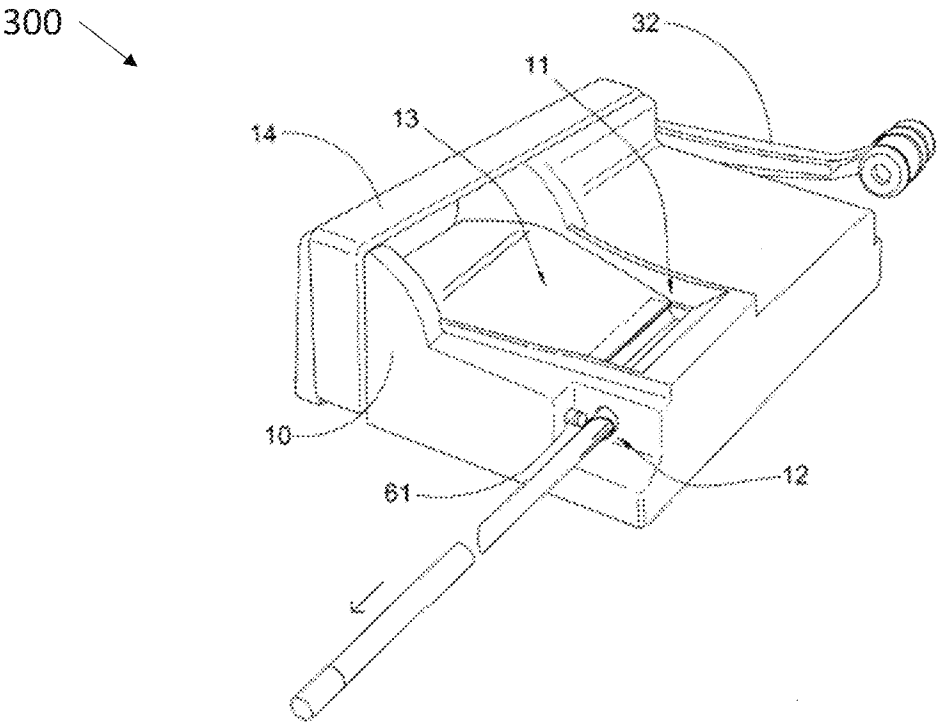
FIG.3C PRIOR ART
FIG. 3C is an example embodiment of a perspective view of a conventional cigarette tobacco filler device, illustrating the operation handle at a third position for being pivotally and downwardly moved for completing the tobacco insertion actuation.

In order to operate the prior art cigarette tobacco filler device shown, the user is able to pivotally move the operation handle 32 upward from the top side of the casing 10 in order to move the enclosing window 40 for opening up the tobacco receiving cavity 11, as shown in FIG. 3A. At the same time, the tube holding member 61 is moved away from the outlet 12 for the cigarette tube coupling with the outlet 12. Then, the user is able to fill the tobacco into the tobacco receiving cavity 11. When the user ergonomically applies the downward force at the operation handle 32 to pivotally move the operation handle down toward the top side of the casing 10, as shown in FIG. 3B, the enclosing window 40 will be initially actuated to close the tobacco receiving cavity 11 while the tube holding member 61 is moved to the outlet 12 for holding the cigarette tube in position. Excessive amounts of tobacco will be cut by the cutting edge of the enclosing window 40 to prevent excessive amount of tobacco being inserted into the cigarette tube. Accordingly, the user is able to hold at the handle bar 14 to keep the casing 10 in stable for easily applying the downward force at the operation handle 32. When user keeps applying the downward force at the operation handle 32 to pivotally move the operation handle down to the top side of the casing 10, as shown in FIG. 3C, the plunger 21 is actuated to insert the tobacco into the cigarette tube. During the tobacco inserting operation, the enclosing window 40 is remained at the closed position. Once the operation handle 32 cannot be further moved downwardly, i.e. the tobacco inserting operation is completed, the cigarette tube hold-and-release unit 60 is actuated to release the cigarette tube from the outlet 12.

Accordingly, the user only requires a single downward action to pivotally drop down the operation handle 32 in order to hold the cigarette tube in position, to close the tobacco receiving cavity 11, to fill the tobacco into the cigarette tube, and to release the filled cigarette tube from the outlet 12.

Alternative embodiments of manually operated cigarette making machines can include rotational drive modules which provide different benefits, such as simplified construction, fewer moving parts and cost savings. Further, electronic cigarette making machines can perform many or all of the operations that can be performed by manually operated machines. These can include processing modules that execute instructions that are stored in memory and cause steps to be performed. Processing modules can be powered by batteries or connection to other power sources, such as electrical outlets when plugged in or otherwise electrically coupled.

FIGS. 8 through 18 illustrate example embodiments of a cigarette making machine constructed in accordance with the present invention.

Figure 8:
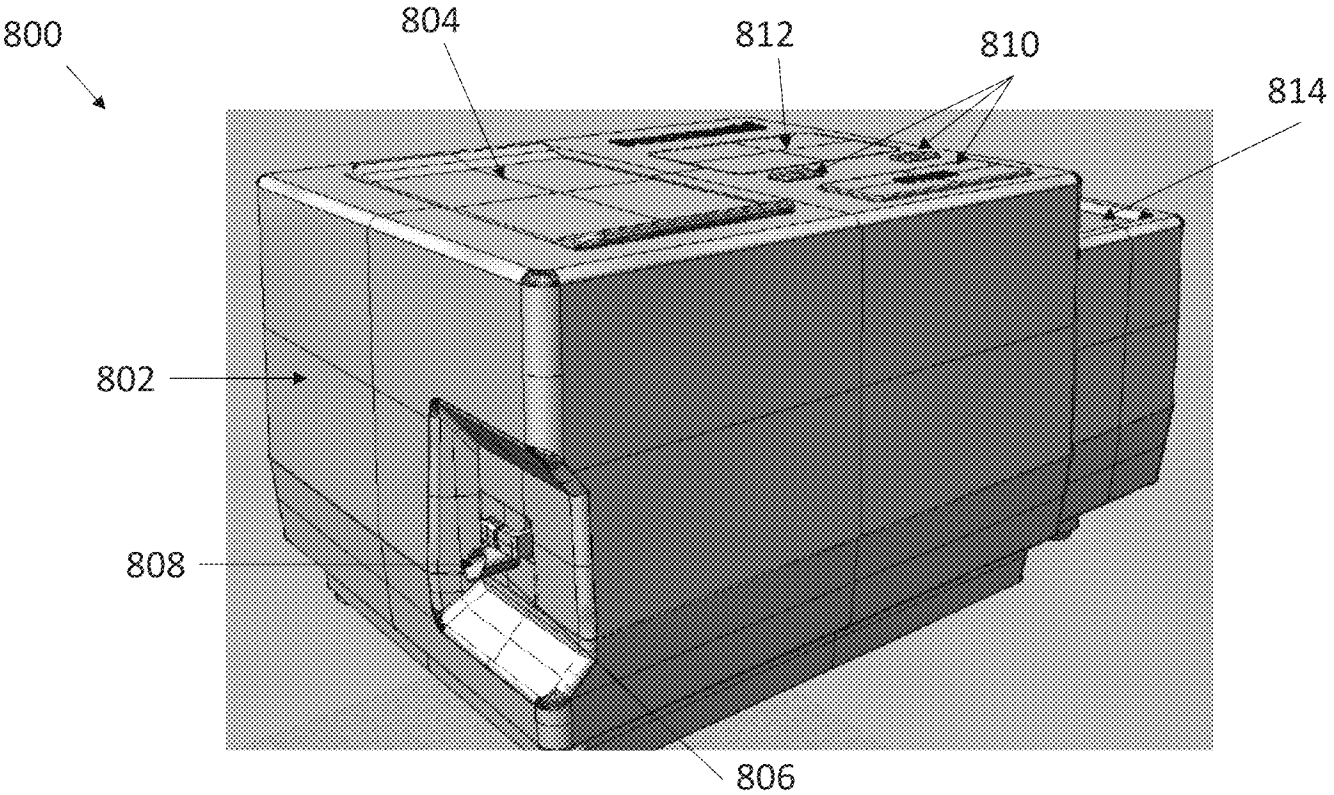
FIG. 8 is an example embodiment of a cigarette making machine diagram from a front perspective view.

Turning first to FIG. 8, an example embodiment of a cigarette making machine diagram 800 is shown from a front perspective view. As shown in the example embodiment, a cigarette making machine can have a body or casing 802. Body 802 can include one or more pieces that are coupled together and provide protection for and hold internal components of the cigarette making machine. Body 802 can include a door 804 that is operable to open a tobacco chamber (not shown) that houses tobacco to be packed and inserted into cigarette tubes. In various embodiments, door 804 can rotate about a fixed pivot point, slide open, or open by other mechanisms. In some embodiments, door 804 can be latched or otherwise fixed in place during use or storage. Also shown is a cigarette casing storage compartment 814, which can include a door in some embodiments. Additional components, compartments, and functionality are contemplated in various embodiments. The cigarette making machine shown is electrically powered and provides efficiency, effectiveness, and optimization of operations over prior art manually operated machines and other electronic cigarette making machines.

During operation, cigarette tubes can be placed around or otherwise near a cylindrically or other shaped nozzle 806 and receive tobacco through a hollow chamber therein via opening 808. As shown, various buttons 810 can include start buttons, stop buttons, pressure or density adjustment buttons, power buttons, or others, as appropriate. These allow users to control various functions of the machine, such as packing cigarettes to their particular preferences.

Information related to operation of the cigarette rolling machine can be displayed via user device display 812. In some embodiments, this can be a LED screen, LCD screen, touchscreen, or other display. Those in the art should understand that power can be supplied to screen 812 via a cable or one or more batteries with appropriate connections that are operably coupled. Power can also be supplied to a processing unit including one or more processors, memory, and other electrical components via appropriate connections and couplings. Thus, functionality of the machine can be controlled via buttons 810 that cause processing units and modules to perform one or more tasks that programmed as a set of instructions and stored in non-transitory computer memory.

Figure 9A:
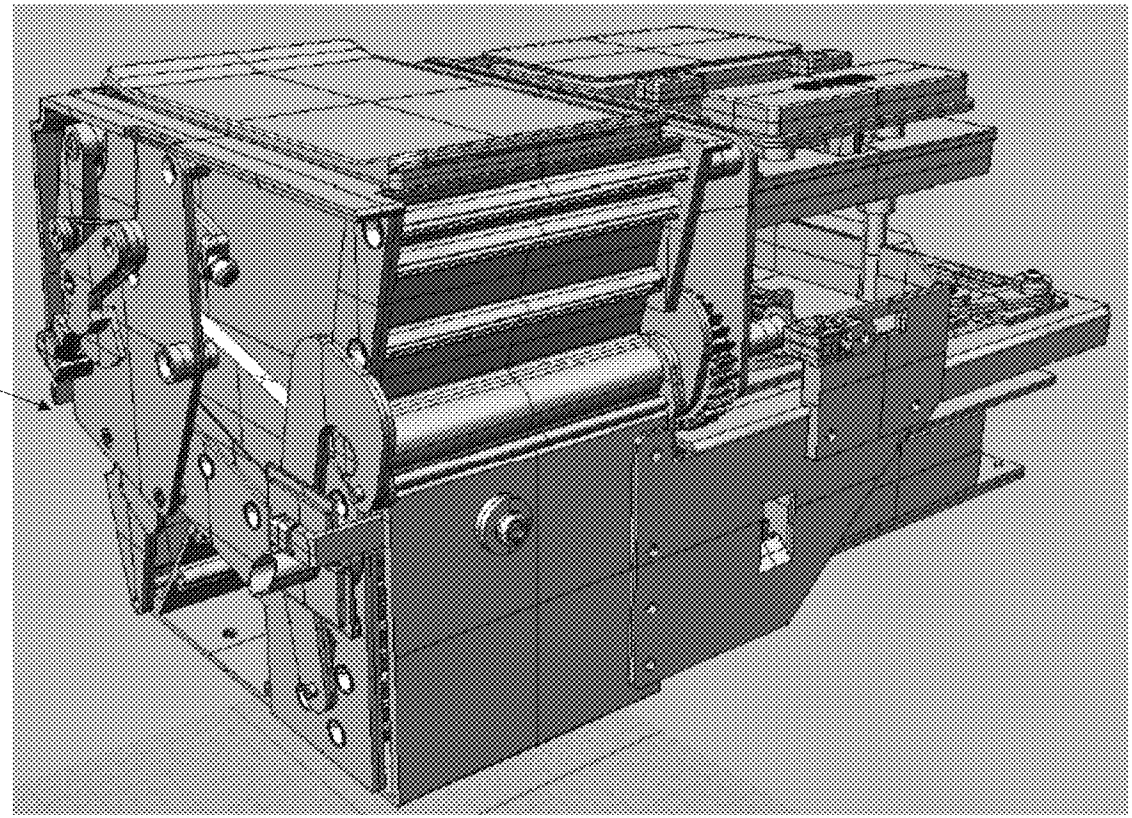
FIG. 9A is an example embodiment of a cigarette making machine diagram from a front perspective cutaway view.

FIG. 9A is an example embodiment of a cigarette making machine diagram 900 from a front perspective cutaway view. As shown in the example embodiment, casing 802 of FIG. 8 has been removed, showing various internal housings and support structures, which will be further described with respect to the additional figures and the novel and inventive features of the present invention.

Figure 9B:
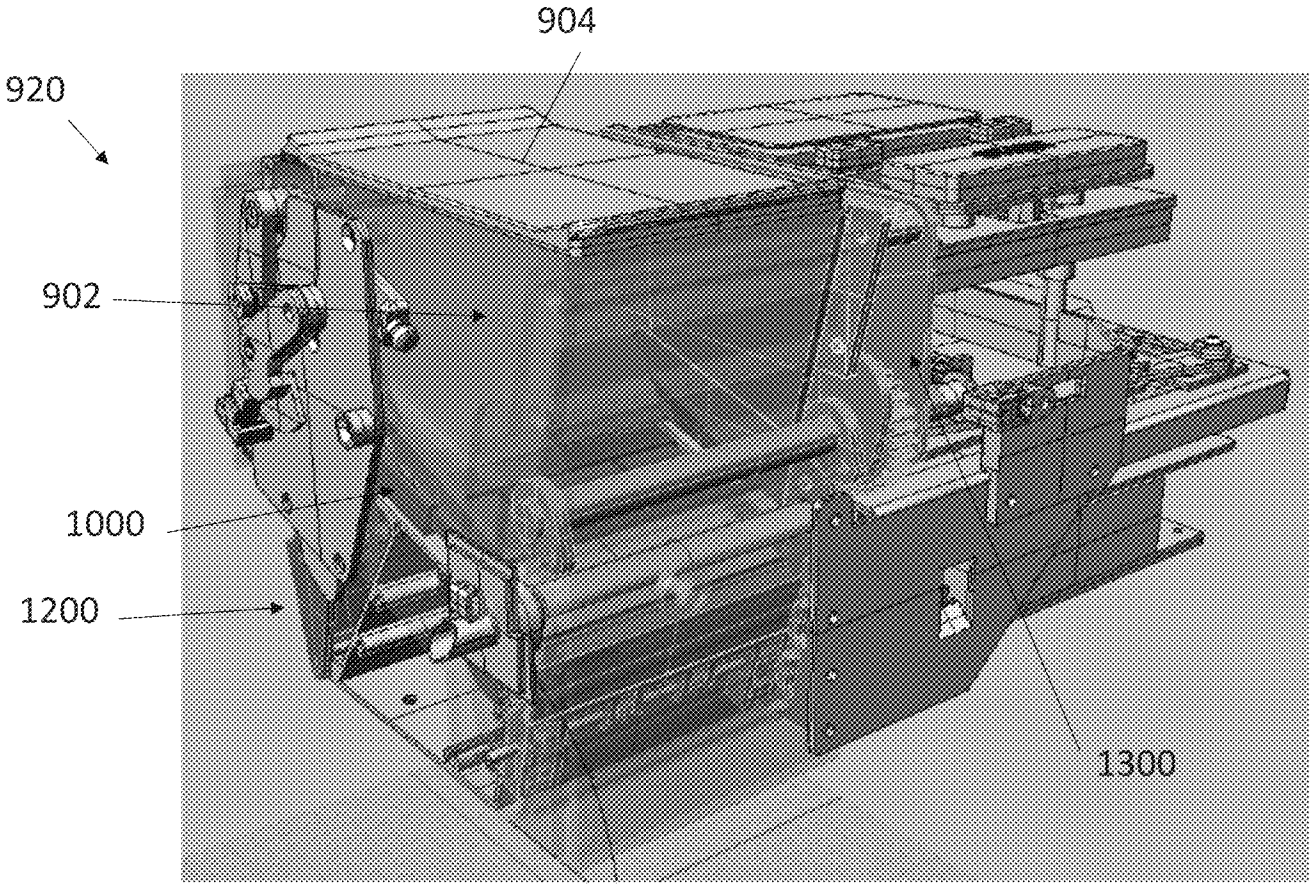
FIG. 9B is an example embodiment of a cigarette making machine diagram from a front perspective cutaway semi-transparent view.

FIG. 9B is an example embodiment of a cigarette making machine diagram 920 from a front perspective cutaway semi-transparent view. The example embodiment depicts general locations and orientations of various internal components with respect to one another. Portions of an agitator module 1200 can be located about portions of a packer module 1000, inside a packing chamber 902, the interior of which is accessible via a door 904. Most components of a compressor module 1300 can be located generally exterior to the packing chamber or hopper 902 within the cigarette making machine.

Figure 9C:
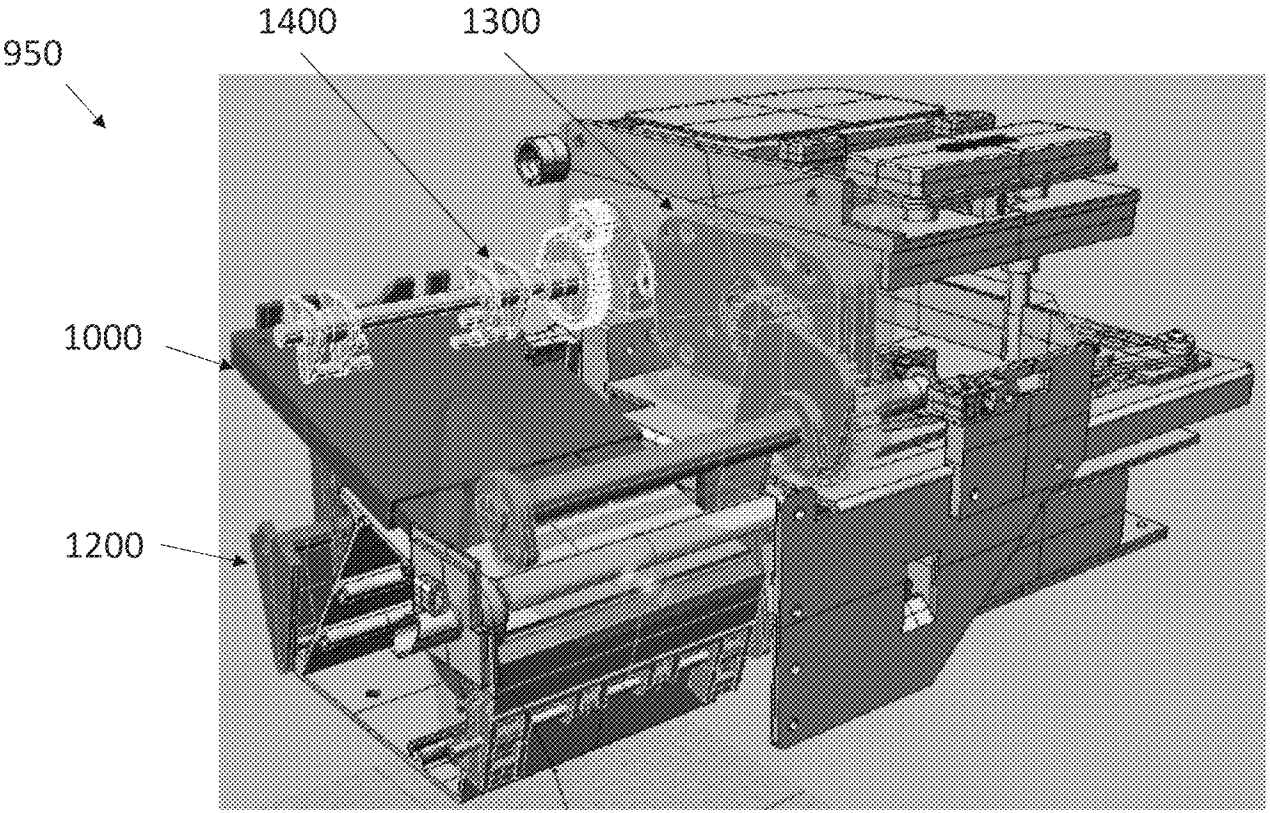
FIG. 9C is an example embodiment of a cigarette making machine diagram from a front perspective cutaway view.

FIG. 9C is an example embodiment of a cigarette making machine diagram 950 from a front perspective cutaway view. Here, support and housing structures have been removed to show general locations and orientations of a tobacco packer module 1000, tobacco agitator module 1200, tobacco compressor module 1300, and compression adjustment module 1400. These will be discussed further with respect to FIGS. 10-14. In some embodiments, the agitator module vibrates at a constant rate. In some embodiments, the agitator module vibrates at a variable rate. This can also be variable oscillation in some embodiments, such that it is not a single rate. Wherein the tobacco can at least partially adhere to the agitator module.

Figure 10:
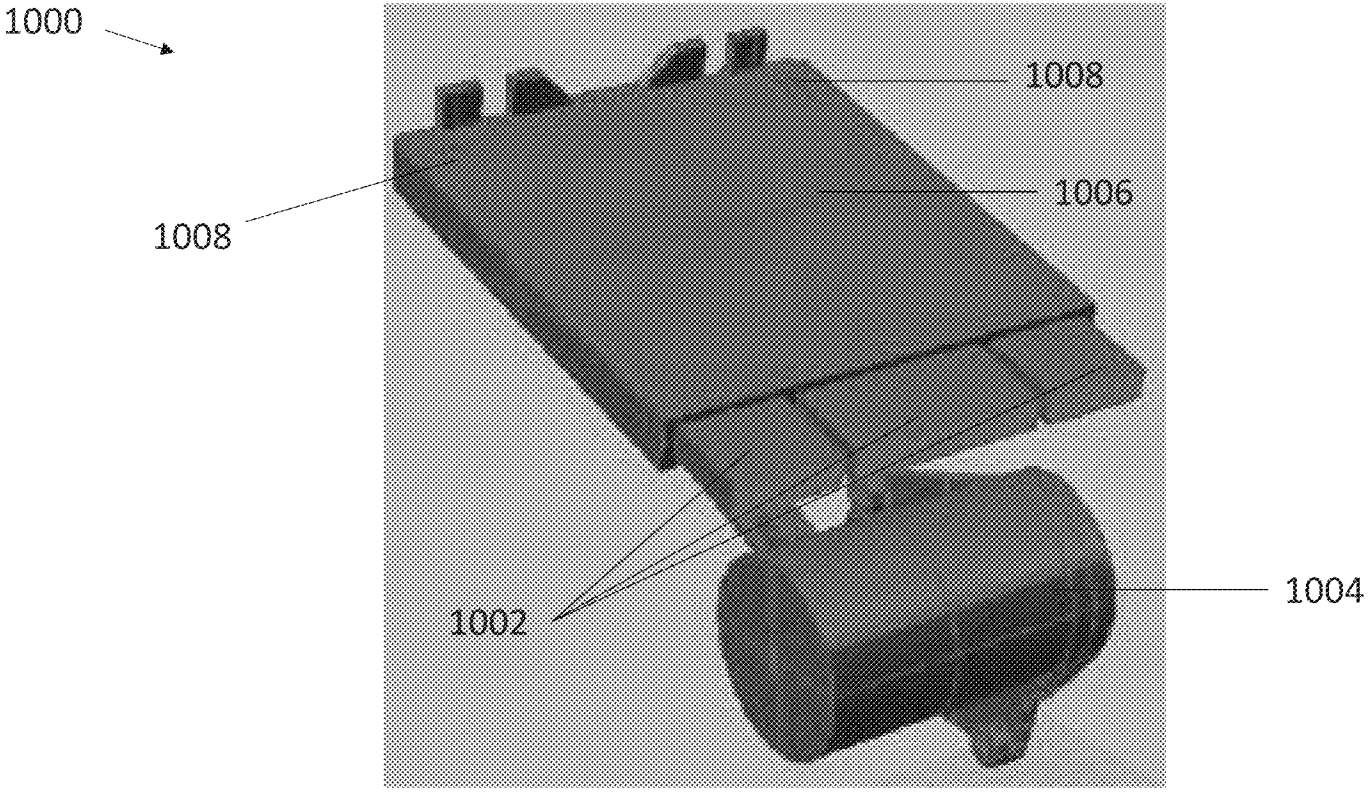
FIG. 10 is an example embodiment of a tobacco packer module diagram from a perspective view.

FIG. 10 is an example embodiment diagram of a tobacco packer module 1000 from a perspective view. In various embodiments, packer module 1000 can include one or more spring loaded "fingers" 1002 that are located partially within an interior hollow space of a platform 1006 and extend outward therefrom in one direction in an initial orientation. The example embodiment shown includes three fingers 1002 that are oriented parallel with one another in a downward angled orientation and are generally rectangularly box shaped. Fingers 1002 are operable to pack tobacco at their initially extended ends into a tobacco packing chamber using reciprocating motion that slides them back and forth within platform 1006. As such, they are slidably coupled to an interior of platform 1006 and are prevented from falling out or otherwise decoupling from platform 1006 by internal structures such as lips (not shown). Motion can be caused, controlled, or otherwise influenced by power from a motor 1004. Motor 1004 can be electrical or electromechanical in various embodiments.

During operation, one or more sensors (not shown) is operable to detect when compacted tobacco reaches a desired or otherwise adequate density or compression according to preset conditions. In this manner, the mechanical "fingers" consistently pack the tobacco to a predetermined density or compression and compactness to allow proper construction of the finished cigarette. These sensors are positioned above platform 1006 and monitor the status of platform 1006. Here, holes 1008 of platform 1006 can be provided through an upper surface of platform 1006. Holes 1008 can align with holes (not shown) in one or more fingers. Here there are three fingers and the two outermost fingers 1002 located nearest the sides of platform 1006 have holes in them. When fingers 1002 are pushed upward and into the platform, these holes in the fingers can align with holes 1008 to allow light to pass through holes 1008 in platform 1006. This light can trigger the one or more sensors (not shown) such as phototransistors or other sensing mechanisms, devices, or components to stop, terminate, or otherwise end a packing operation. In particular, when tobacco for the cigarette has been sufficiently compressed based on a predetermined compression condition, the fingers used to compress the tobacco will be moved sufficiently such that their holes are aligned with the holes 1008 to allow the passage of light, which thereby actuates the light sensor. When this light sensor is actuated, this causes the machine to stop further compression. In other words, using fingers 1002 having a predetermined compression condition, the device of the present invention may reliably and repeatedly pack tobacco for insertion into cigarette tubes to create cigarettes that allow for proper burning of the cigarette during smoking activities.

Figure 11B:
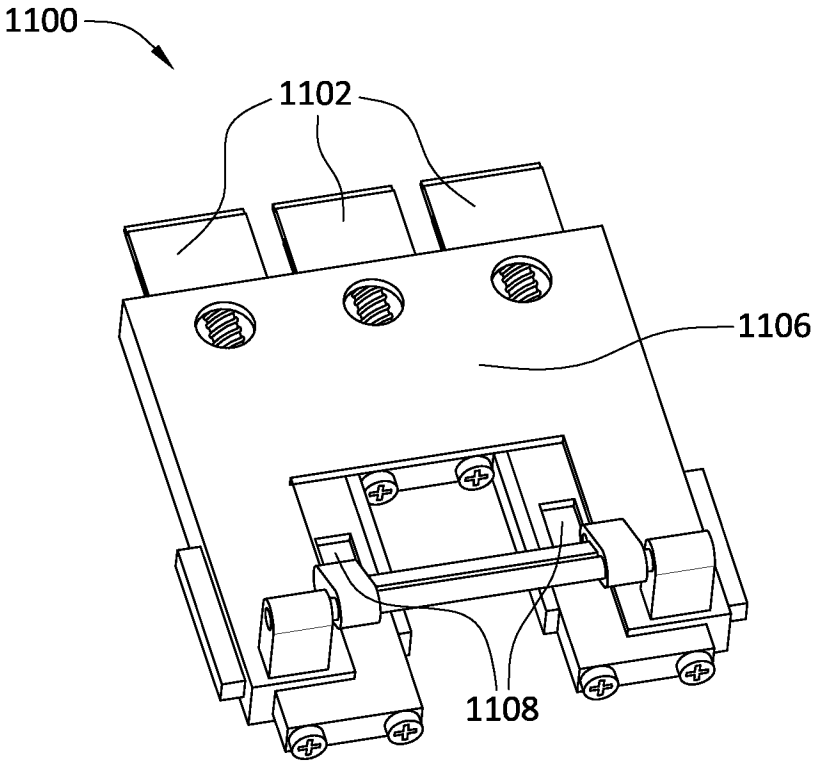
FIG. 11B is an example embodiment of a tobacco packer module image from a bottom-up, rear perspective view.
Figure 11A:
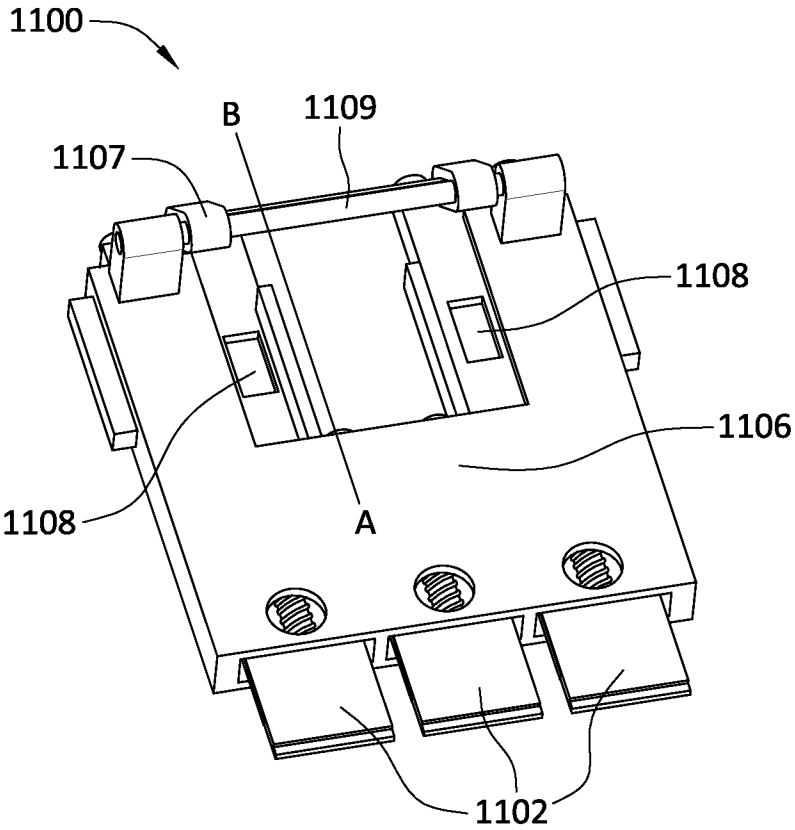
FIG. 11A is an example embodiment of a tobacco packer module image from a bottom-up, front perspective view.

FIG. 11A is an example embodiment of a tobacco packer module image 1100 from a bottom-up, front perspective view. As shown in the example embodiment, fingers 1102 can be one or more generally rectangularly shaped structures that include springs. As such, they can be partially or wholly spring loaded and slidably coupled within platform 1106. Fingers 1102 can be displaced in a forward or backward direction along an axis parallel to axis A-B.

As described with respect to FIG. 10, fingers 1102 can move to pack tobacco shreds or flakes. In some embodiments, the motor can cause them to vibrate. The motor can be coupled by one or more arms, as shown in FIG. 10, that is also coupled with a pivoting arm 1107. This can be further pivotably coupled with a bar 1109 that is coupled in a fixed configuration to platform 1106. As such, pivoting arm 1107 is operable to partially rotate about bar 1109. In some embodiments, fingers 1102 can transmit vibrations to improve movement of tobacco flakes, as caused by the motor. Also, as described with respect to FIG. 10, optical sensors can be used to sense the status of a tobacco packing operation by monitoring light through holes 1103 of fingers 1102.

FIG. 11B is an example embodiment of a tobacco packer module image 1110 from a bottom-up, rear perspective view. A generally outline of a finger 1102 orientation is shown by the dashed box. Fingers 1102 can be monolithic in some embodiments, while in others they can include one or more structures that are bonded together by adhesives or otherwise coupled through appropriate coupling means.

Figure 11D:
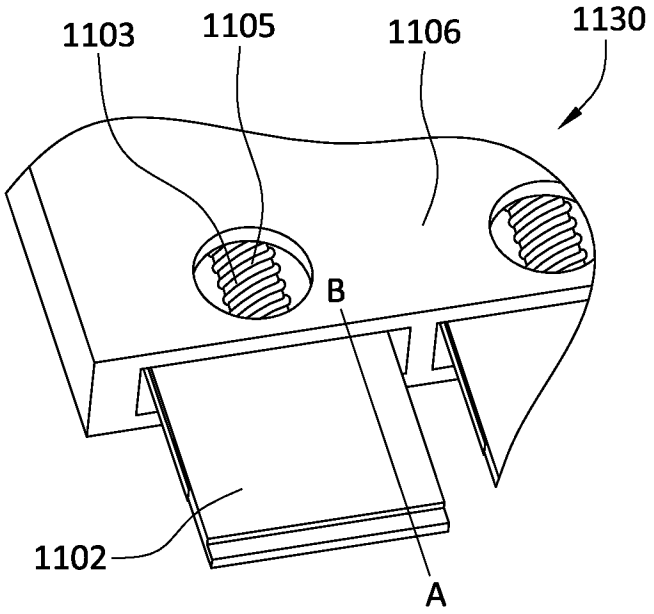
FIG. 11D is an example embodiment of a tobacco packer module arm image from a front perspective view.
Figure 11C:
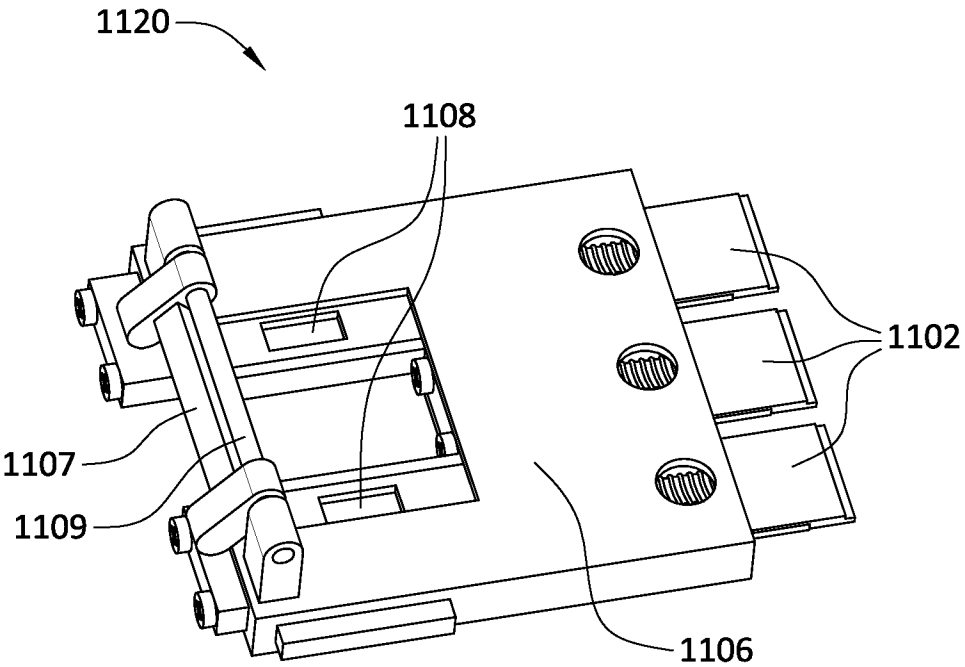
FIG. 11C is an example embodiment of a tobacco packer module image from a bottom-up, side-rear perspective view.

FIG. 11C is an example embodiment of a tobacco packer module image 1120 from a bottom-up, side-rear perspective view.

FIG. 11D is an example embodiment of a tobacco packer module arm image 1130 from a front perspective view. Movement and positioning of fingers 1102 can be influenced and controlled by springs (see e.g. 1103 of FIG. 11C) that are movably coupled with the fingers. As shown, the one or more fingers 1102 are generally held or pushed toward a forward position in the direction of A on axis A-B by one or more springs 1103. Springs 1103 are mounted or suspended between a forward and backward wall (not shown) circumferentially about a shaft 1105 of finger 1102 in the example embodiment. Springs 1103 can independently control movement of each finger 1102 or more than one finger 1102 can be coupled together and controlled by springs 1103 in various embodiments. In some embodiments, spring force can be about four pounds per inch, while in others it can be varied, as appropriate. Some embodiments include springs each having differing spring forces.

Packing operations can be performed by platform 1106 movement, which can influence fingers 1102 to move. When a front end of fingers 1102 contacts tobacco near its end toward A of axis A-B, movement of platform 1106 in the direction of A causes the end of fingers 1102 to push against the tobacco, in turn causing compression of springs 1103 and therefore packing of tobacco.

Figure 11F:
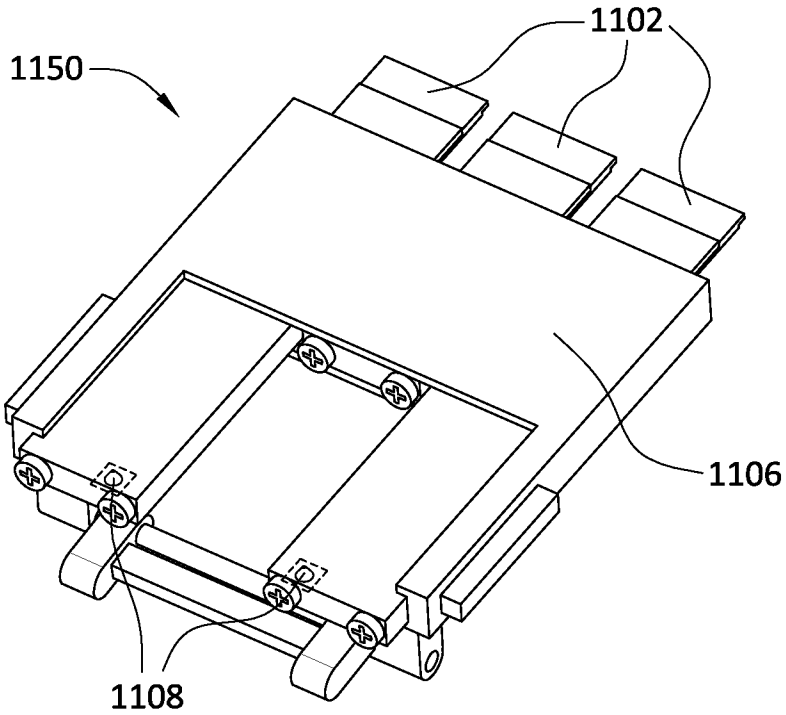
FIG. 11F is an example embodiment of a tobacco packer module image from a top-down, rear perspective view.
Figure 11E:
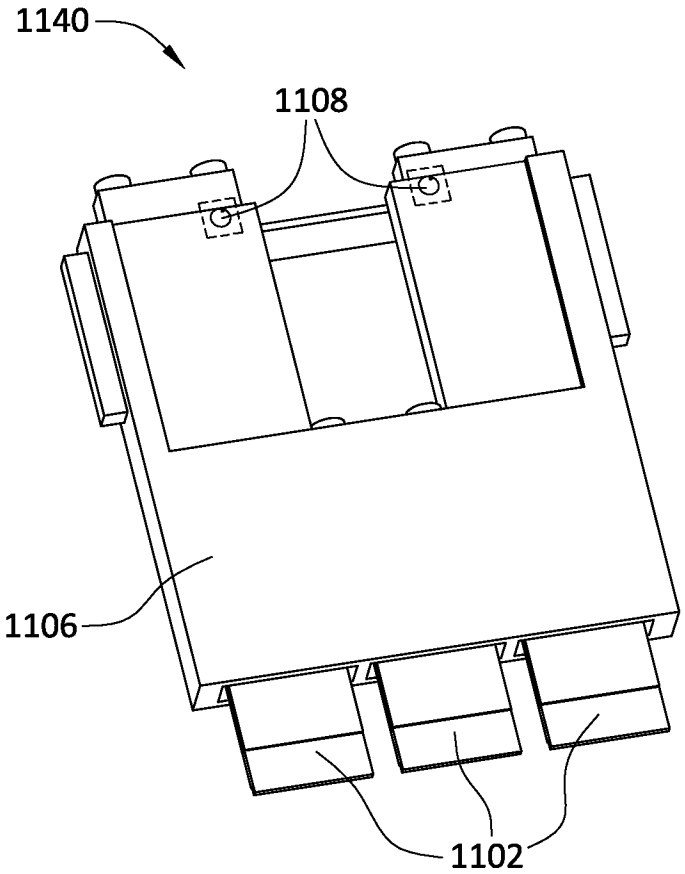
FIG. 11E is an example embodiment of a tobacco packer module image from a top-down, front perspective view.

FIG. 11E is an example embodiment of a tobacco packer module image 1140 from a top-down, front perspective view. As shown in the example embodiment, holes 1108 in platform can be blocked with fingers 1102 are in an initial orientation.

FIG. 11F is an example embodiment of a tobacco packer module image 1150 from a top-down, rear perspective view. As shown, screws 1111 or other coupling mechanisms can be used to couple one or more components of fingers 1102 to each other. In some embodiments, an end of fingers 1102 that is opposite a tobacco impacting and packing end can come into contact with one or more counter-springs that is mounted or otherwise coupled in an appropriate position within the machine to support packing operations.

Hole orientation for optical sensing will now be described with respect to FIGS. 11G-11H.

Figure 11H:
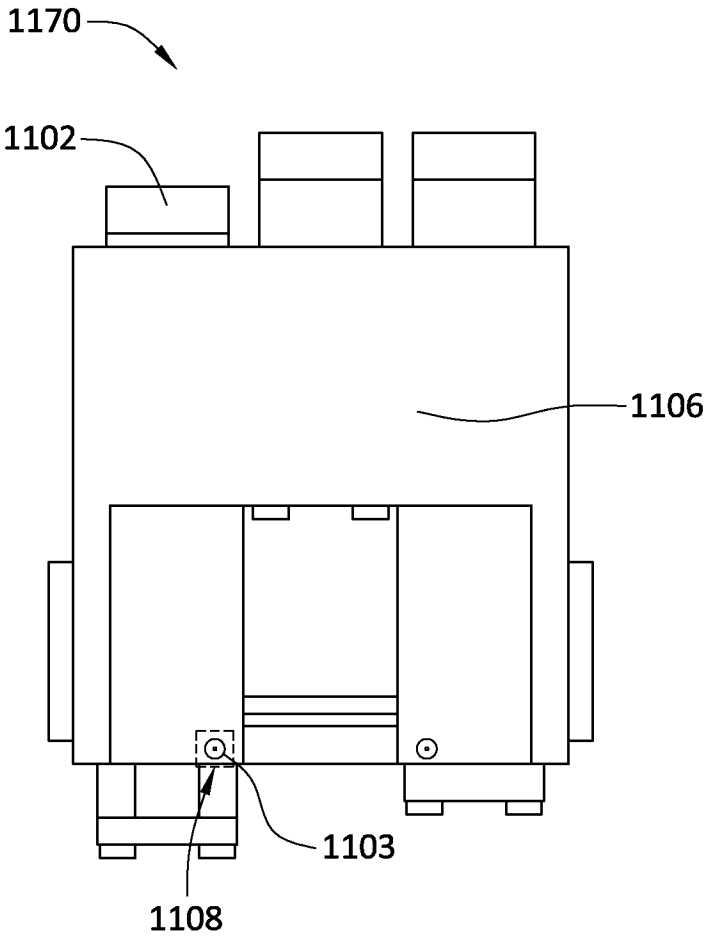
FIG. 11H is an example embodiment of a tobacco packer module image from a top-down, view.
Figure 11G:
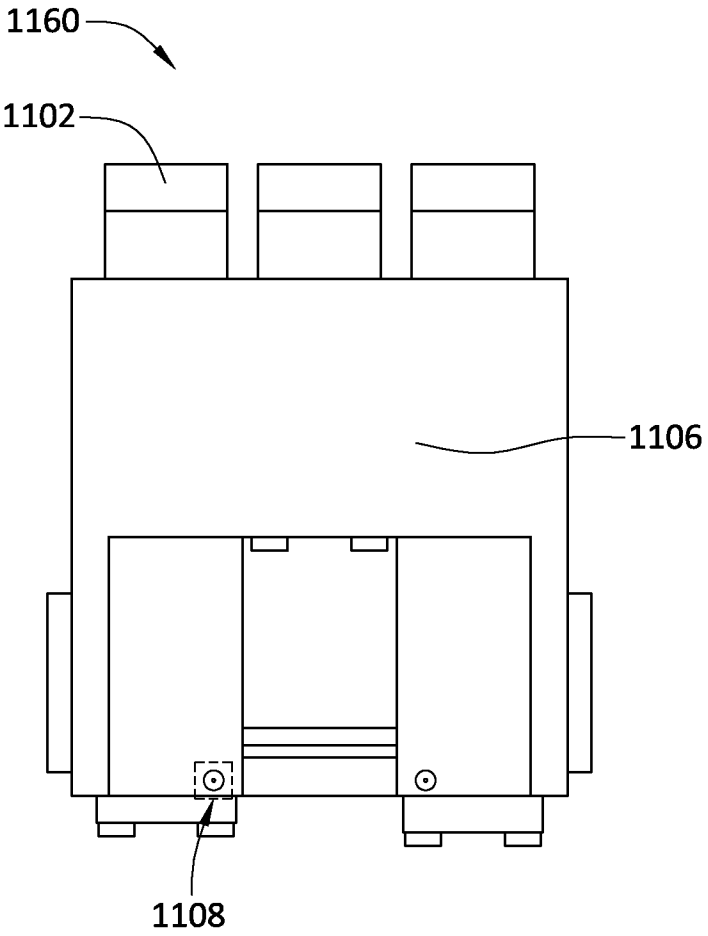
FIG. 11G is an example embodiment of a tobacco packer module image from a top-down, view.

FIG. 11G is an example embodiment of a tobacco packer module image 1160 from a top-down, view. As shown in the example embodiment, when a finger 1102 is in an initial orientation, a hole 1108 of platform 1106 is blocked by the body of finger 1102. Thus, a sensor positioned to monitor hole 1108 is unable to see through finger 1102. In some embodiments, optical resistors can be used, while in others, optical transistors can be used. Those in the art should understand that these are mounted or otherwise coupled in a location within the machine such that they can operably perform the sensing described herein.

FIG. 11H is an example embodiment of a tobacco packer module image 1170 from a top-down, view. As shown in the example embodiment, fingers 1102 can be pushed out of their initial position, as shown in FIG. 11G. This can cause a compression of a spring, as shown and described with respect to FIG. 11D. This spring compression can cause a hole of finger 1102, e.g. hole 1103 of FIGS. 11A-11C, to align with hole 1108 of platform 1106. Thus, a sensor positioned to monitor hole 1108 can sense that the holes are aligned and a processor that is operably coupled to the sensor can cause the machine to cease operation, due to tobacco being adequately packed. As shown in the example embodiments of FIGS. 11G-11H, a body of finger 1102 can be colored black, as shown in FIG. 11G. Then, when holes 1103 and 1108 are aligned, as shown in FIG. 11H, a white color or a light can be seen through the aligned holes and sensed by the sensor. Platform 1106 can cover the majority of each finger 1102 in some embodiments, with only a portion of a tobacco compacting end exposed in various embodiments.

Figure 12:
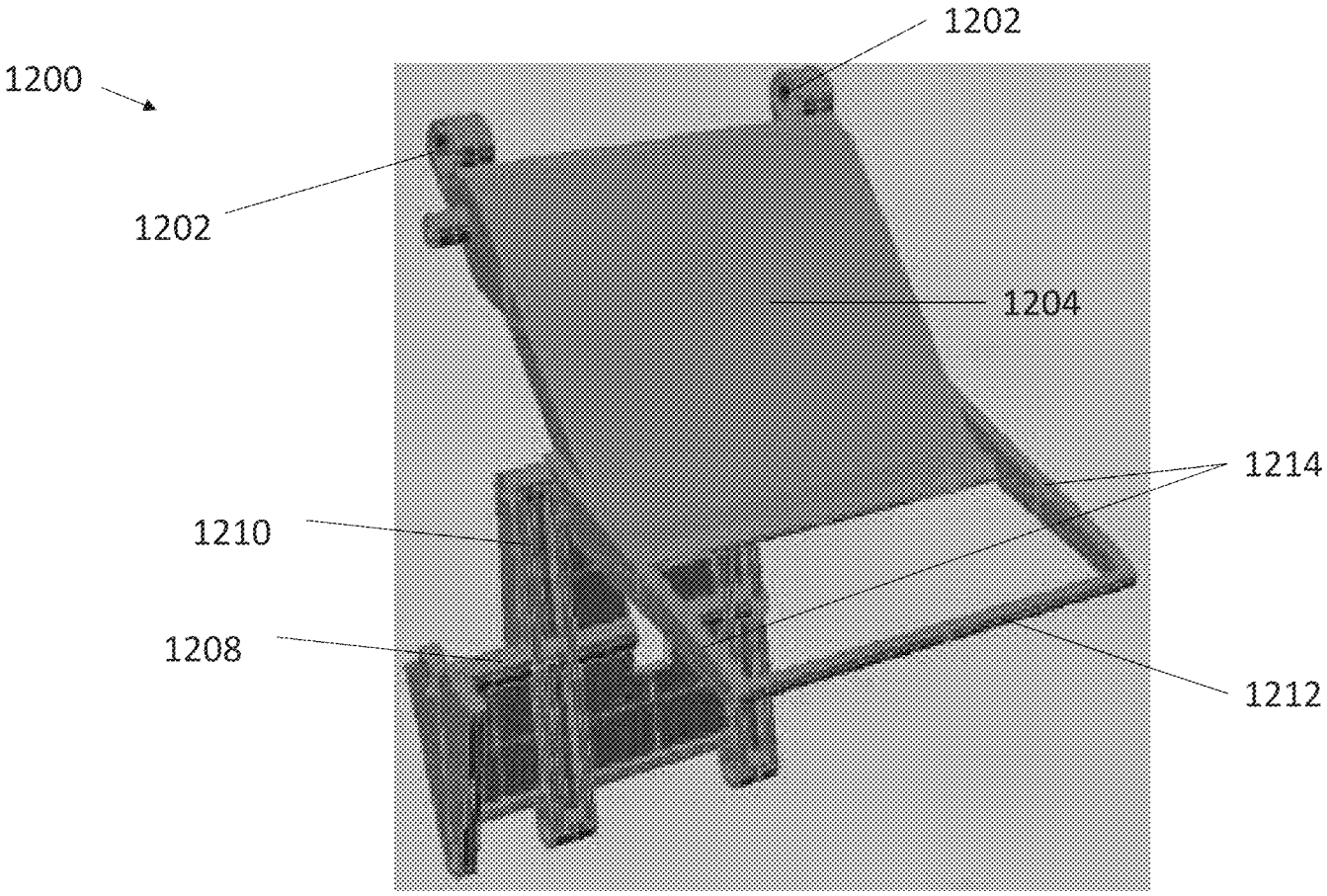
FIG. 12 is an example embodiment of a tobacco agitator module diagram from a perspective view.

FIG. 12 is an example embodiment of a tobacco agitator module diagram 1200 from a perspective view. An agitator module can include one or more pivot locations 1202, located at one or more locations of an agitator panel 1204. Here, these locations are at an upper end of agitator panel 1204. These pivot locations can be coupled with a bar that is coupled with an arm of a tobacco packer module, e.g. 1107 of FIG. 11A-C. In some embodiments, panel 1204 is located above or near a top side of a tobacco packer module, as shown in FIG. 9B.

In the example embodiment, the pivoting motion of the tobacco agitator module can be powered or otherwise influenced by the same motor that operates a tobacco packer module, e.g. motor 1004 of FIG. 10. As such, the position of agitator module pivot locations 1202 can be influenced by movement of a cam 1208 that is coupled with the motor and that is slidably or otherwise coupled with one or more movable arms 1210. Cam 1208 can move with about three quarters of an inch arc length when influenced by motor control. As such, agitator panel 1204 can then shake, vibrate, or otherwise move tobacco, such that it falls downward in a hopper. In other words, in various embodiments tobacco that is placed in the machine will generally be located on a top or angled upward facing surface of agitator panel 1204 and then slide down the surface when the machine is in operation.

To elaborate, as shown in the example embodiment agitator panel 1204 can be generally located in an angled position. This allows tobacco to be agitated downward toward a lower end, where it can be packed and delivered into a cigarette tube. In some embodiments, this can be about 75 degrees or other angles or ranges of angles. This can provide the advantage of using the force of gravity to assist in packing operations, as compared with horizontal platforms in previous tobacco packing machines. Additionally, some prior art packing machines perform vertical packing operations, which can cause a variety of problems that are reduced or eliminated by using an angled platform.

Additionally, one or more agitator bars or rods 1212 are operable to move and help to guide tobacco to the front end of fingers of a packer module. In some embodiments, this can be done with respect to agitator panel 1204, while in others it can be done independently. Rod or agitator bar 1212 is coupled to arms 1210 via one or more guide arms 1214. Thus, agitator bar 1212 can be used to move, push, or otherwise influence tobacco position when the machine is in operation. Particularly, agitator bar 1212 can push tobacco into a chamber for delivery into a cigarette tube. As such, agitator bar 1212 can increase the likelihood that a cigarette will be successfully packed. In various embodiments, this can be include pushing the tobacco in front of the fingers (see e.g. FIG. 11A-11H) of a packer module, that is then pushed into the chamber by the fingers. In some embodiments, agitator bars can assist or otherwise function to hold tobacco in front of fingers, circulate tobacco that has stagnant position, or provide other functions.

Figure 13:
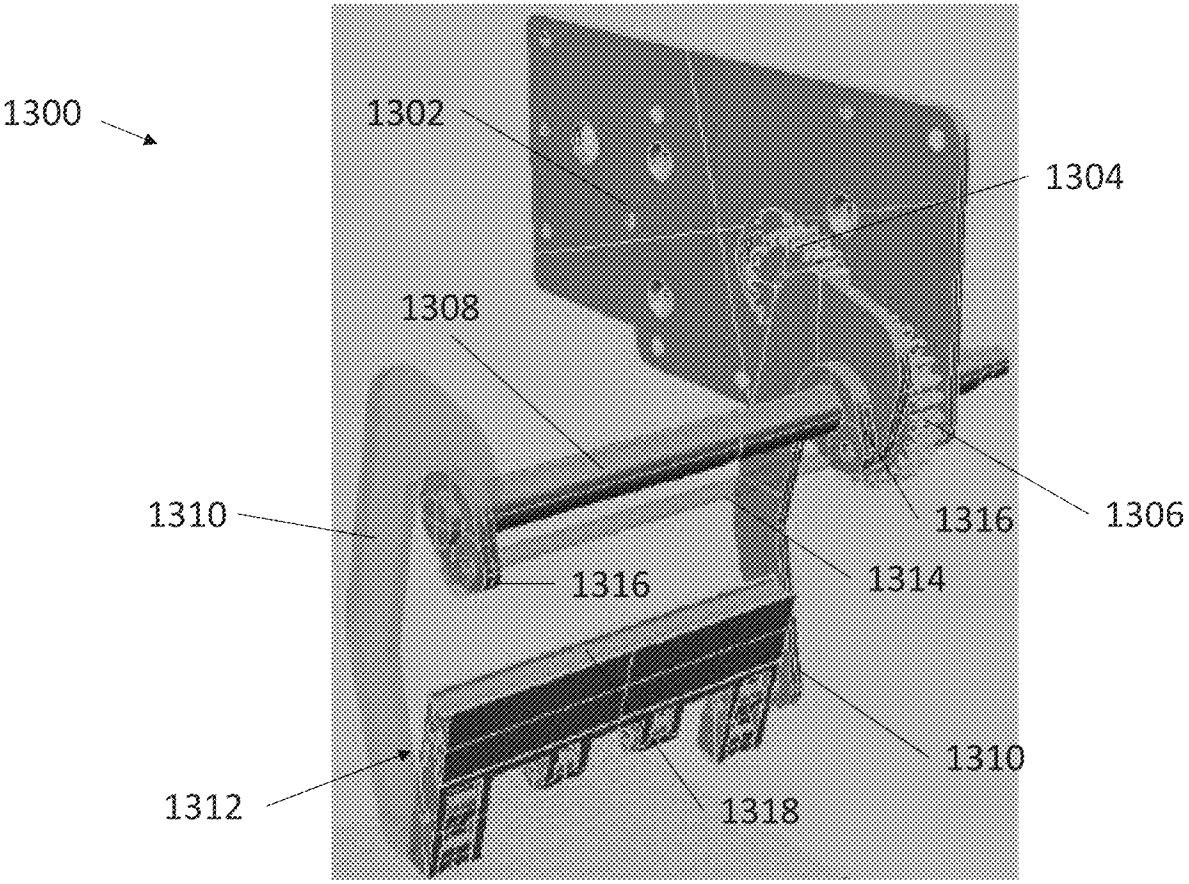
FIG. 13 is an example embodiment of a tobacco compressor module diagram from a perspective view.

FIG. 13 is an example embodiment of a tobacco compressor module diagram 1300 from a perspective view. In the example embodiment, a compressor module can be powered by a separate motor (not shown) that is independent of a packer module motor. In the example embodiment, the compressor module powering motor can be a compressor motor, such as a stepper motor, that is located on an opposite side of a panel 1302 from a primary drive gear 1304 through a hole (not shown) via a shaft (not shown). In some embodiments, this can be a plain gear motor that is controlled with one, two, or more light sensors. These can include a light blocking mask that is attached to an axle of gear 1306. The position can be sensed and may be noted by a coupled processor that one, two, or more final positions, such as chamber open or chamber closed, of gear 1306 has been achieved. In some embodiments, no compressor motor is required for adjustment of compressor module components. They can be controlled by other motors, or function independently.

This motor can be operable to turn gear 1304 through a range of degrees. In some embodiment, this can be back and forth through a range of about one hundred and eighty degrees. Gear 1304 can have teeth that are operable to drive complementary shaped and movably coupled teeth of a secondary drive gear 1306. Gears 1304 and 1306 can be positioned such that when their teeth engage, rotation of gear 1304 in one direction causes rotation of gear 1306 in the opposite direction. Secondary gear 1306 can be permanently or removably coupled with a cylindrical or other shaped driveshaft 1308 that rotates about an axis and is coupled with at least one pivot mechanism 1316. A secondary driveshaft 1314 can be permanently or removably coupled to pivot mechanism 1316 such that when driveshaft 1308 rotates, secondary driveshaft 1314 rotates circumferentially about driveshaft 1308. Secondary driveshaft 1314 can be coupled with one or more arms 1310, such that its movement causes arms 1310 to move. Arms 1310 can be pivotably coupled with a compressor component 1312.

As shown in the example embodiment, compressor component 1312 can be angled upward with respect to a flat supporting surface plane in an initial orientation. Here, compressor component 1312 is angled about 75 degrees upward. This can be considered "upside-down" in some embodiments and is a repositioning from prior types of spoons, which are generally horizontal. This angle allows tobacco to fall into a compression chamber channel 1318 of component 1312 more easily when compared to conventional cigarette injector machines. Additionally, this angle also allows for tobacco to fall while also being packed. Chamber channel 1318 can then be pushed or otherwise moved upward by movement of arms 1310 such that a spoon can receive the tobacco and push it outward through a nozzle (e.g. nozzle 806 of FIG. 8) and into an appropriately positioned cigarette tube.

In some embodiments, one or more motors of the machine may go through several rounds of operations in order to pack a cigarette. As such, three to five or other numbers of cycles may be required for a successful packing operation. In some embodiments, this may take a few seconds, about five seconds, or other amounts of time. Various factors can influence this time, including the tobacco type, amount, density, or other tobacco related factors.

Figure 14:
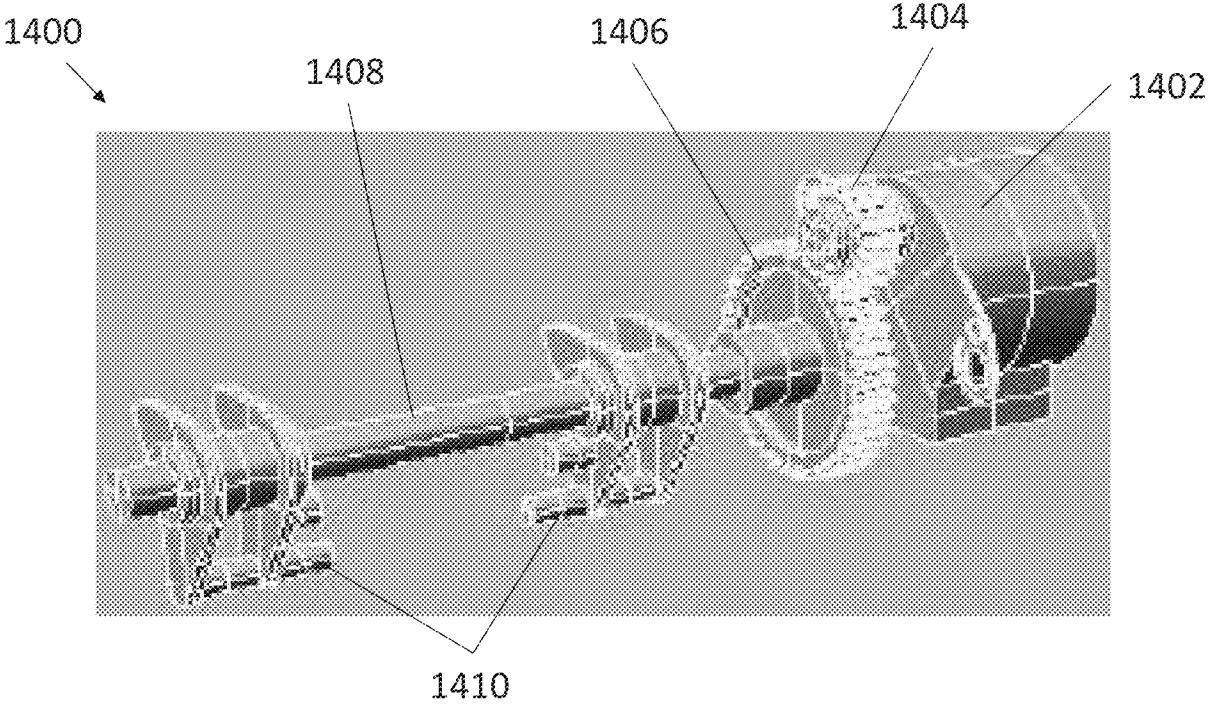
FIG. 14 is an example embodiment of a tobacco compression adjustment module diagram from a perspective view.

FIG. 14 is an example embodiment of a tobacco compression adjustment module diagram 1400 from a perspective view. As shown in the example embodiment, a motor 1402 can be a stepper motor that is coupled to a primary drive gear 1404 directly or indirectly via a centralized shaft (obscured). Gear 1404 can have teeth that are operable to drive complementary shaped teeth of a secondary drive gear 1406. Gears 1404 and 1406 can be positioned such that when their teeth engage, rotation of gear 1404 in one direction causes rotation of gear 1406 in the opposite direction. Secondary gear 1406 can be permanently or removably coupled with a cylindrical or other shaped driveshaft 1408 that rotates about an axis. Rotation of gears 1404, 1406 causes rotation of driveshaft 1408 and thus affects the position of arms 1410 coupled to driveshaft 1410. Arms 1410 can impede or otherwise affect movement, positioning, and orientation of a panel of a tobacco packer module.

In some embodiments, arms 1410 may be spring loaded with a torsion or other spring. As a rear, back, or distal end of fingers (e.g. 1102 of FIG. 11A-11H) contact arms 1410, the coupled torsion spring may counteract some or all of the load from the springs in the fingers. This can reduce the force required by the machine required to push the fingers into the tobacco and trigger a stop command for packing by a coupled processor.

In general, driveshaft 1408 and arms 1410 of the tobacco compression adjustment module can be located below an agitator panel (e.g. 1204 of FIG. 12) and above a platform (e.g. 1006 of FIG. 10) of a tobacco packer module. FIG. 9C shows an example of how a tobacco compression adjustment module can be oriented with respect to a tobacco packer module in a machine, while the tobacco compression adjustment module is obscured in FIG. 9B by an agitator module.

Figure 15:
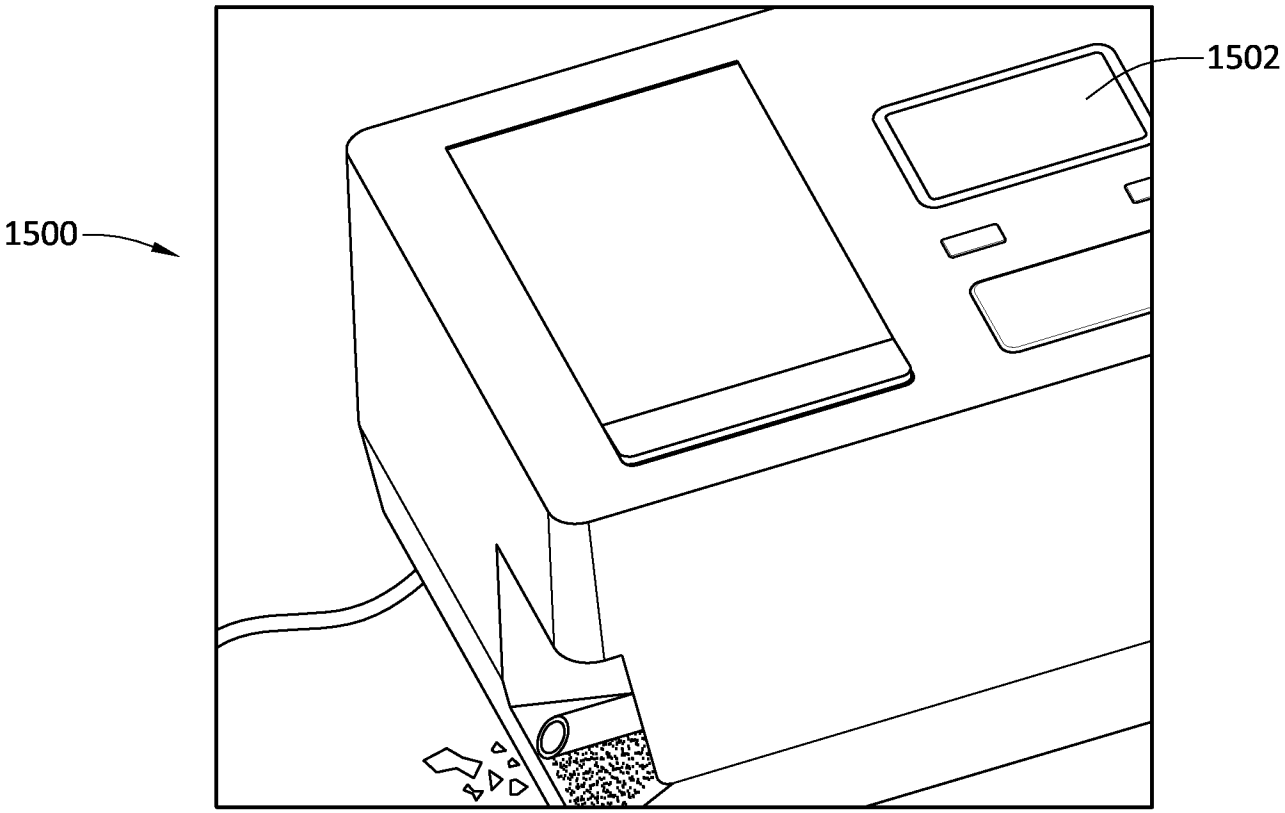
FIG. 15 is an example embodiment image of a cigarette making machine from a perspective view, showing a display.

FIG. 15 is an example embodiment image 1500 of a cigarette making machine from a perspective view, showing a display 1502, user interface buttons 1504, hopper door 1506, and nozzle 1508.

A process for using a cigarette making machine will now be described with respect to FIGS. 16A-16H.

Figure 16A:
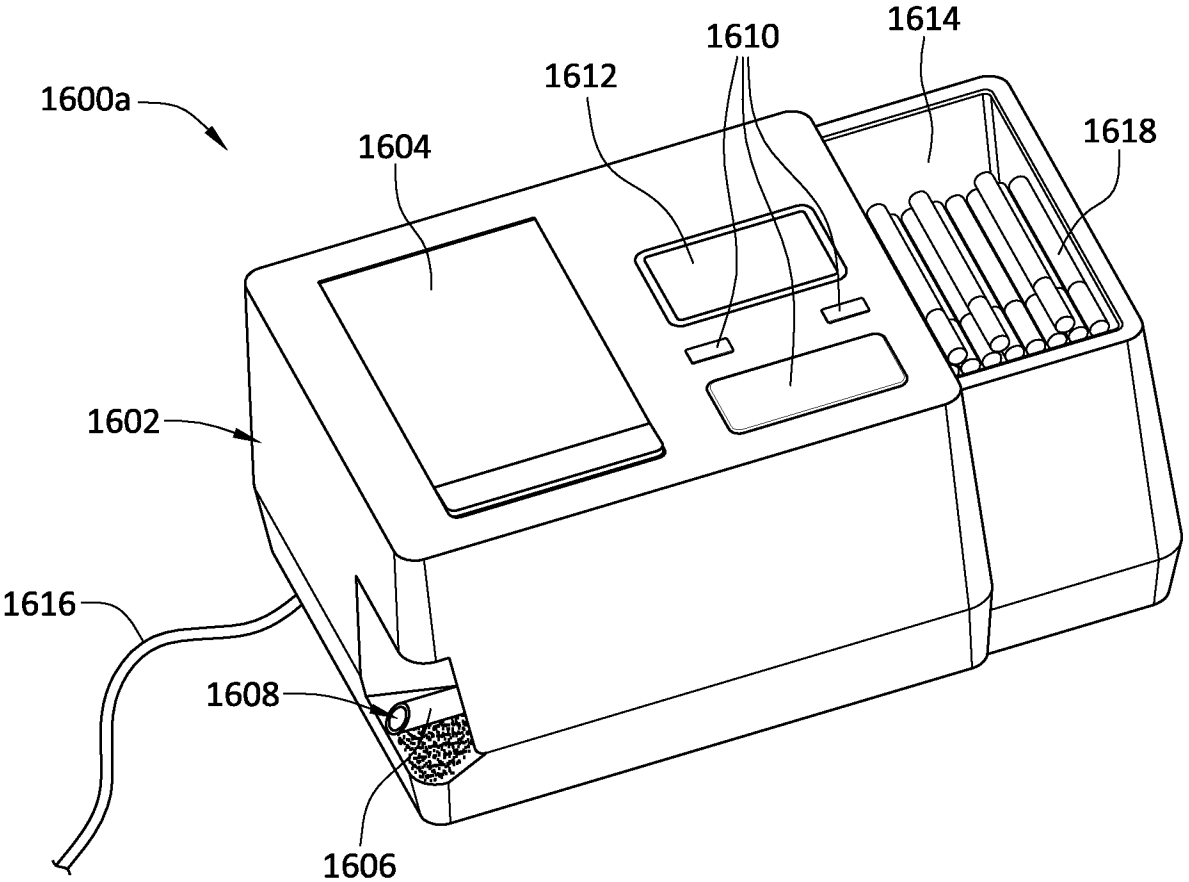
FIG. 16A is an example embodiment of a cigarette making machine image from a front perspective view.

FIG. 16A is an example embodiment of a cigarette making machine image 1600*a* from a front perspective view. As shown in the example embodiment, a cigarette making machine can have a body or casing 1602. Body 1602 can include a door 1604 that is operable to open a tobacco chamber or hopper (obscured) that houses tobacco to be packed and inserted into cigarette casing tubes 1618 that are held in a cigarette casing storage compartment 1614. In the example embodiment, door 1604 rotates about a fixed pivot to open and close. In some embodiments, a door (not shown) can be provided to close cigarette casing storage compartment 1614.

Power for cigarette making machine can be supplied by power cord 1616, and can be used to run cigarette making operations via a processing module (not shown). In some embodiments, voltage can be about 100-240V or other amounts. Processing module operations can be controlled by a user via buttons 1610 and information can be displayed for user review via user device display 1612. Also shown are a nozzle 1606, having an opening 1608 for delivery of packed tobacco into a cigarette tube 1618, when appropriately positioned.

Figure 16B:
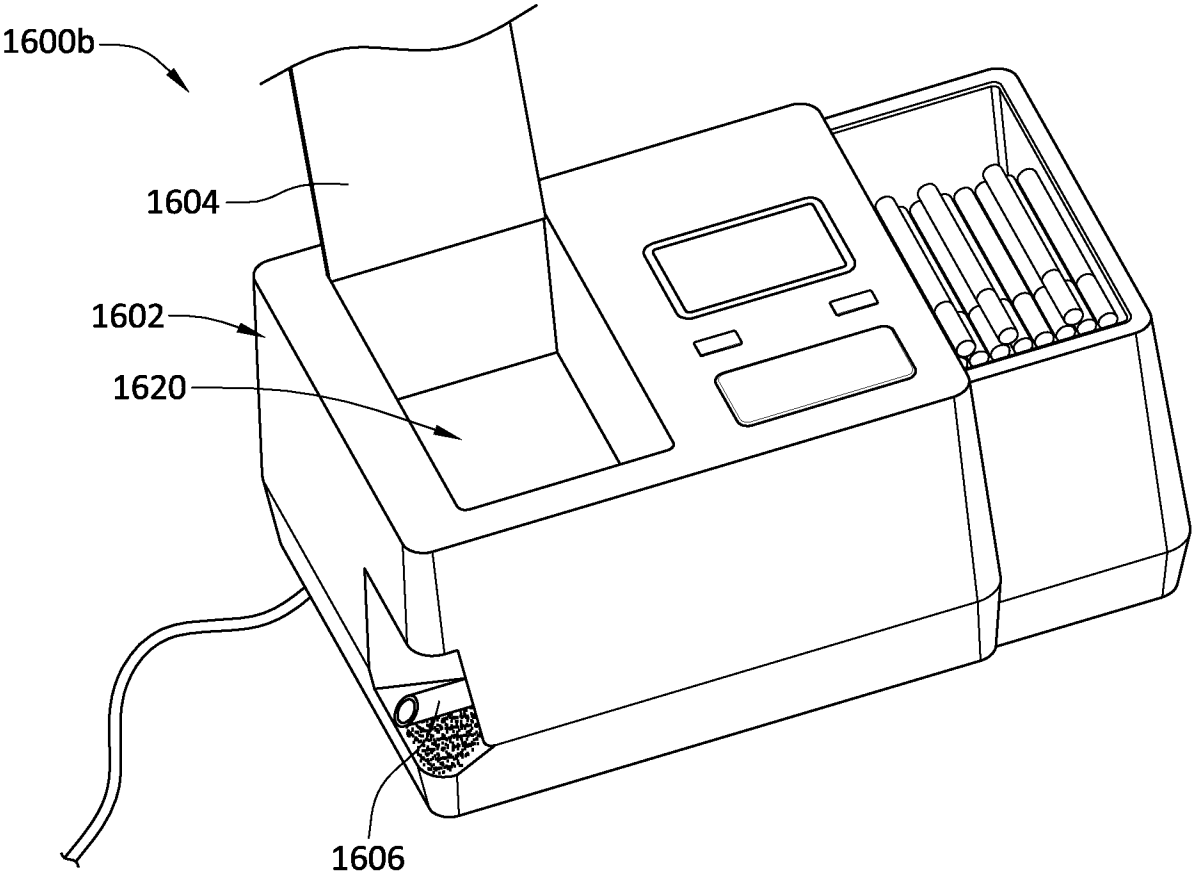
FIG. 16B is an example embodiment of a cigarette making machine image from a front perspective view.

FIG. 16B is an example embodiment of a cigarette making machine image 1600*b* from a front perspective view. As shown in the example embodiment, a user can open door 1604 of body 1602 in order to access a hopper or tobacco packing chamber 1620 for placement of tobacco to be packed and delivered via nozzle 1606.

Figure 16C:
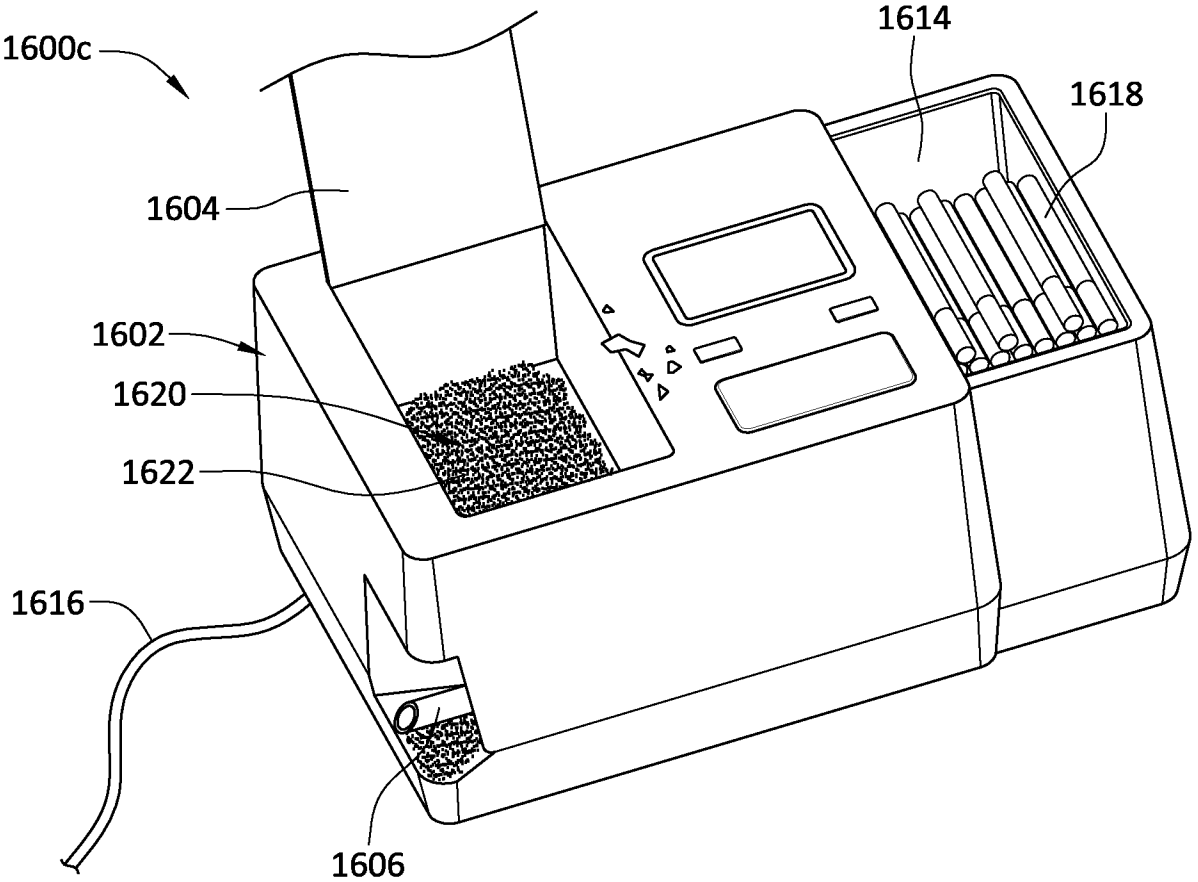
FIG. 16C is an example embodiment of a cigarette making machine image from a front perspective view.

FIG. 16C is an example embodiment of a cigarette making machine image 1600*c* from a front perspective view. As shown in the example embodiment, a user can place loose, shredded tobacco 1622 into chamber 1620 of body 1602 when door 1604 is open. Then the user can select a cigarette casing tube 1618 from storage 1614 for placement on nozzle 1606.

Figure 16D:
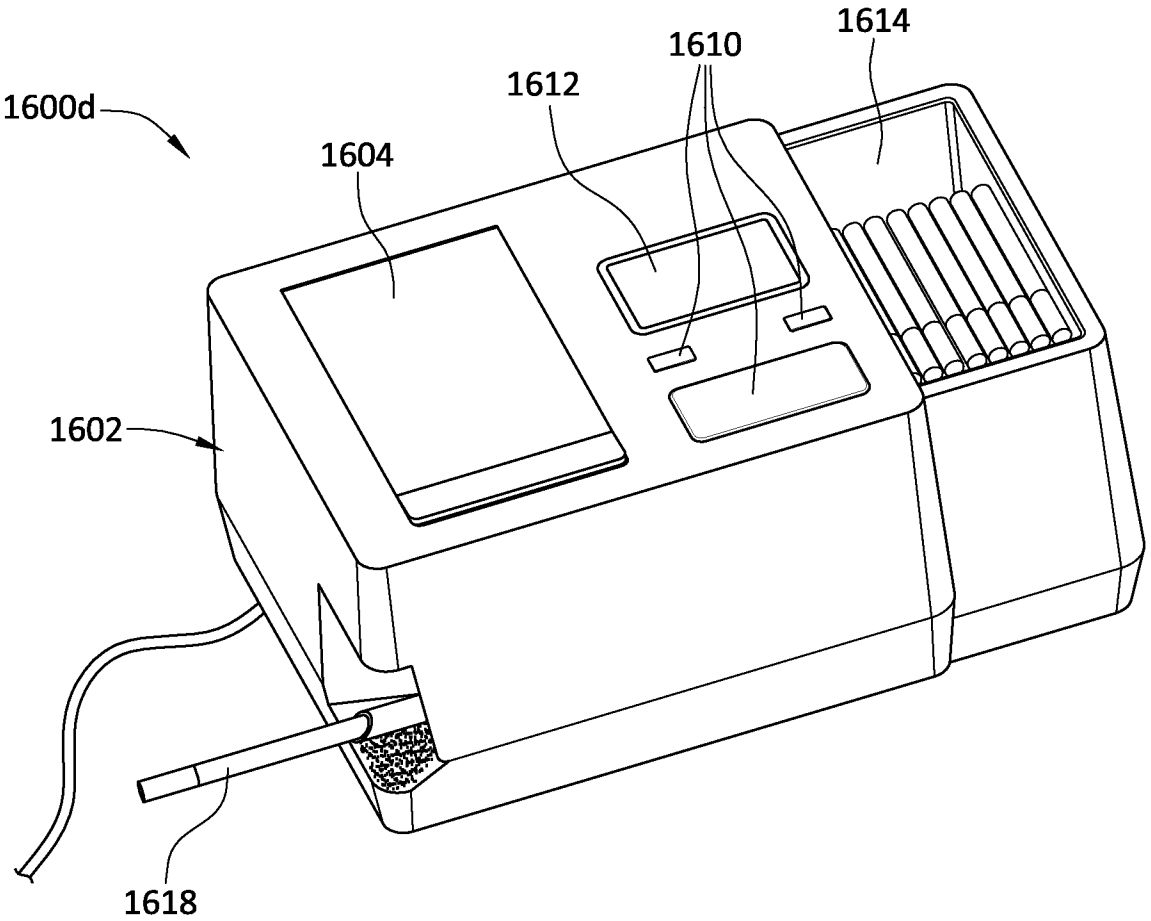
FIG. 16D is an example embodiment of a cigarette making machine image from a front perspective view.

FIG. 16D is an example embodiment of a cigarette making machine image 1600*d* from a front perspective view. As shown in the example embodiment, a user can close door 1604 of body 1602 once shredded tobacco has been placed into the packing chamber. After placing an open end of cigarette casing tube 1618 on the nozzle (obscured), the user can select their preferred settings using buttons 1610. The cigarette making machine can display changes in settings via user device display 1612.

Here, examples of operations that buttons 1610 can control include operations such as on, off, start, stop, density or firmness of cigarette packing, and others. The cigarette making machine can display changes in settings via user device display 1612. Settings displayed can show level of packing firmness, density, or other metrics. This can include an actual or estimated amount of tobacco packed. Examples of information that user device display 1612 can display include numbers, letters, words, infographics, and others. Examples of infographics include pie charts, bar diagrams, and various others. Examples of numerical information that can be displayed include a total number of cigarette tubes packed, total number of machine cycles, and others. In some embodiments, examples of words displayed include "please close door" where a sensor (not shown) may monitor door 1604's position or status. Once cigarette casing 1618 is in place and the user has applied their preferred settings, they can select a start packing button 1610 to begin operation of the packing process.

Figure 16E:
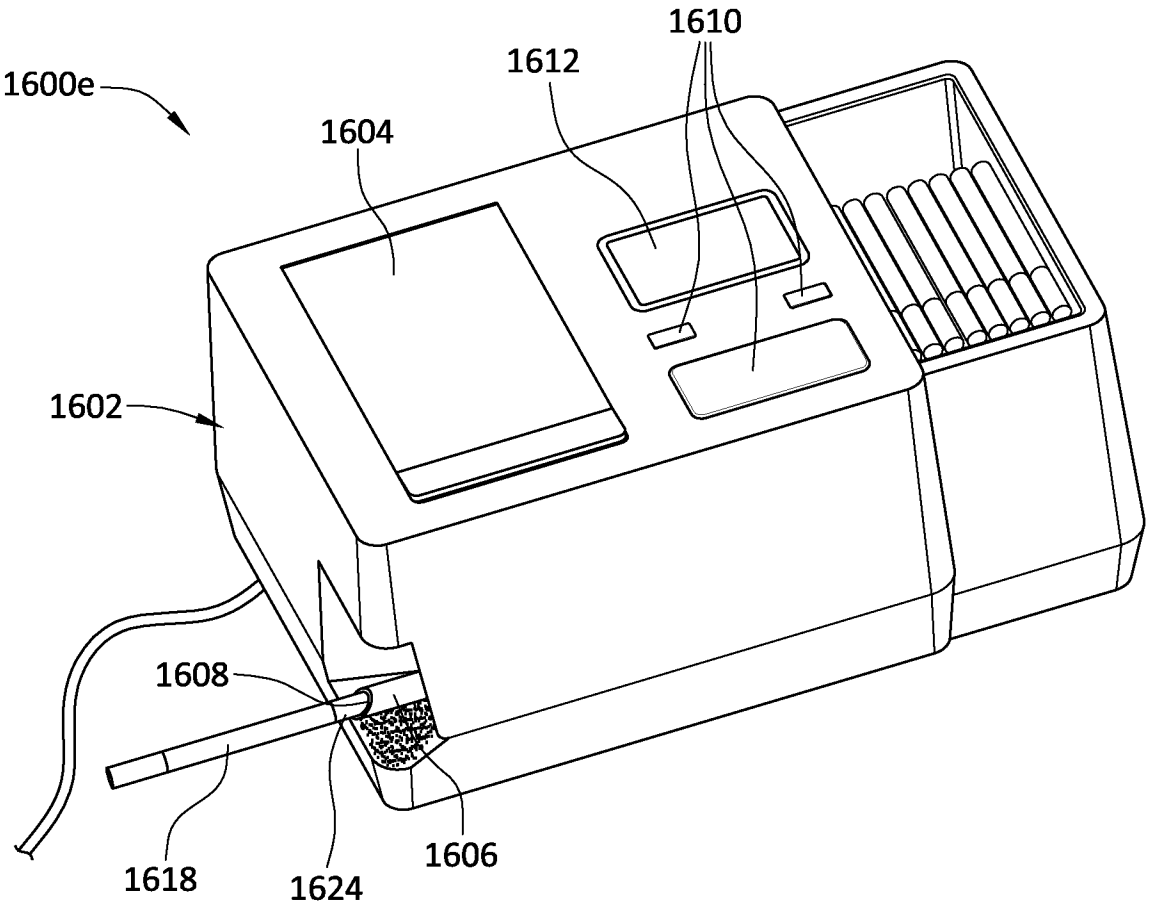
FIG. 16E is an example embodiment of a cigarette making machine image from a front perspective view.

FIG. 16E is an example embodiment of a cigarette making machine image 1600*e* from a front perspective view. As shown in the example embodiment, the user has begun a packing operation and cigarette tube or casing 1618 has received tobacco inside its cylindrical tube. Here a packing spoon 1624 has been actuated and has pushed tobacco through opening 1608 of nozzle 1606 and into casing 1618. The operating of such a spoon 1624 is well known in the art and is illustrated—for example—in U.S. Pat. No. 8,261,752 to Bao, the disclosure of which is hereby incorporated by reference in its entirety. Packing spoon 1624 is operable to extend slightly past the end of nozzle 1606, such that it clears nozzle 1606. In some embodiments, the orientation of spoon 1624 is rotated to use assistance from the natural force of gravity to keep tobacco in an appropriate position in the machine or during delivery to casings 1618. In particular, the inventors have found that is desirable to keep tobacco leaves from accumulating on the outside surface of the spoon 1624 as this may cause jamming or undesirable friction during injection of the cigarette spoon 1624. By reversing the position of the spoon 1624 such the curved outer surface of the spoon 1624 is positioned above a compression chamber channel (e.g. 1318 of FIG. 13), the packed tobacco that is received and held within the spoon 1624 can be held or otherwise pulled downward by gravity in the channel. This helps excess tobacco leaves and debris to fall away from a curved upper or outer surface of spoon 1624 and avoids jamming or other friction during packing operations. Additional description of packing spoon 1624 and its operation in a packing module is provided with respect to FIGS. 19A-19D.

Figure 16F:
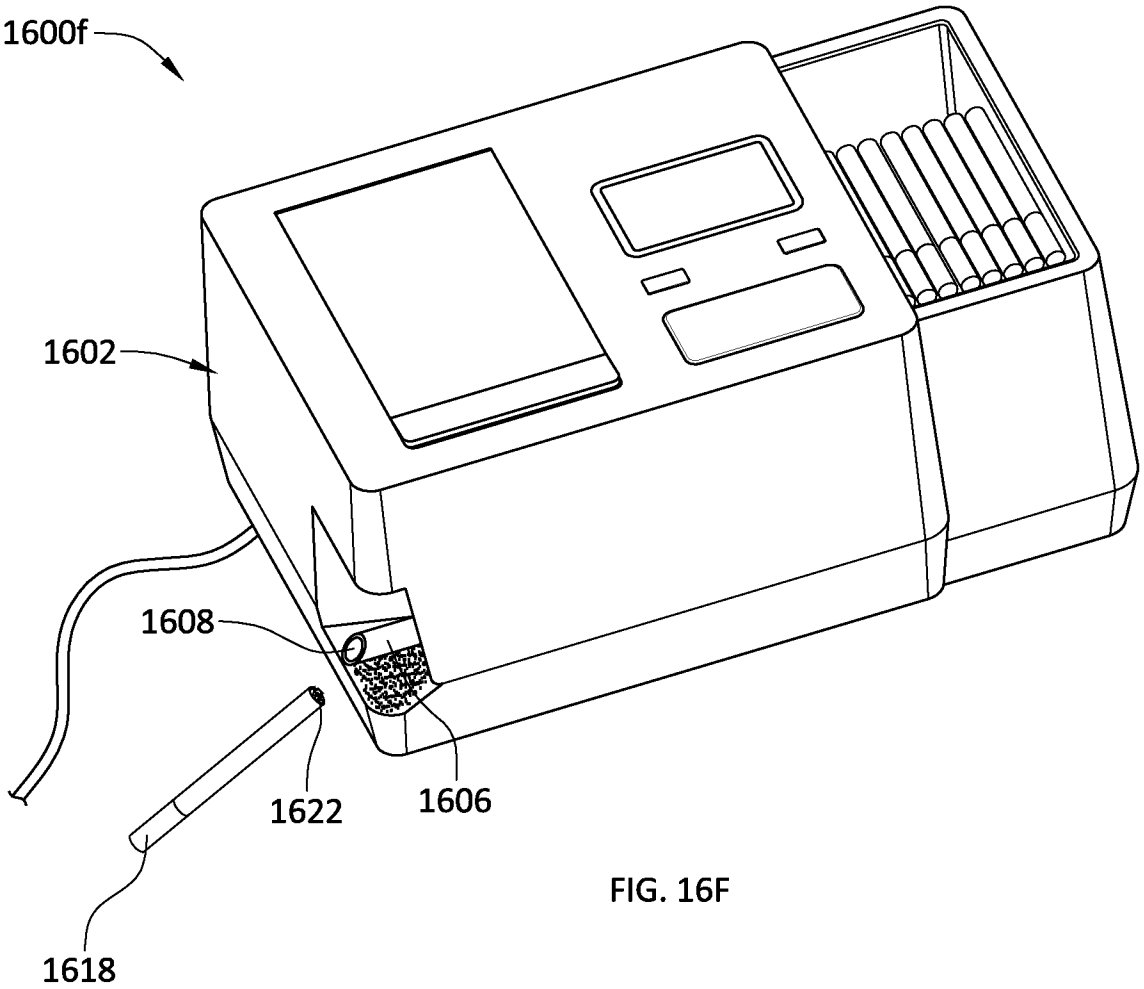
FIG. 16F is an example embodiment of a cigarette making machine image from a front perspective view.

FIG. 16F is an example embodiment of a cigarette making machine image 1600*f* from a front perspective view. Here, cigarette casing 1618 is full of packed tobacco 1622 and has fallen clear of nozzle 1606 and the packing spoon has retracted within opening 1608. In some embodiments, another sensor can be provided that detects if a packing module is fully retracted, to ensure that fingers are never in the chamber when the compressor closes. It can also be used to keep track of cycles that the packing module has run through.

Figure 16G:
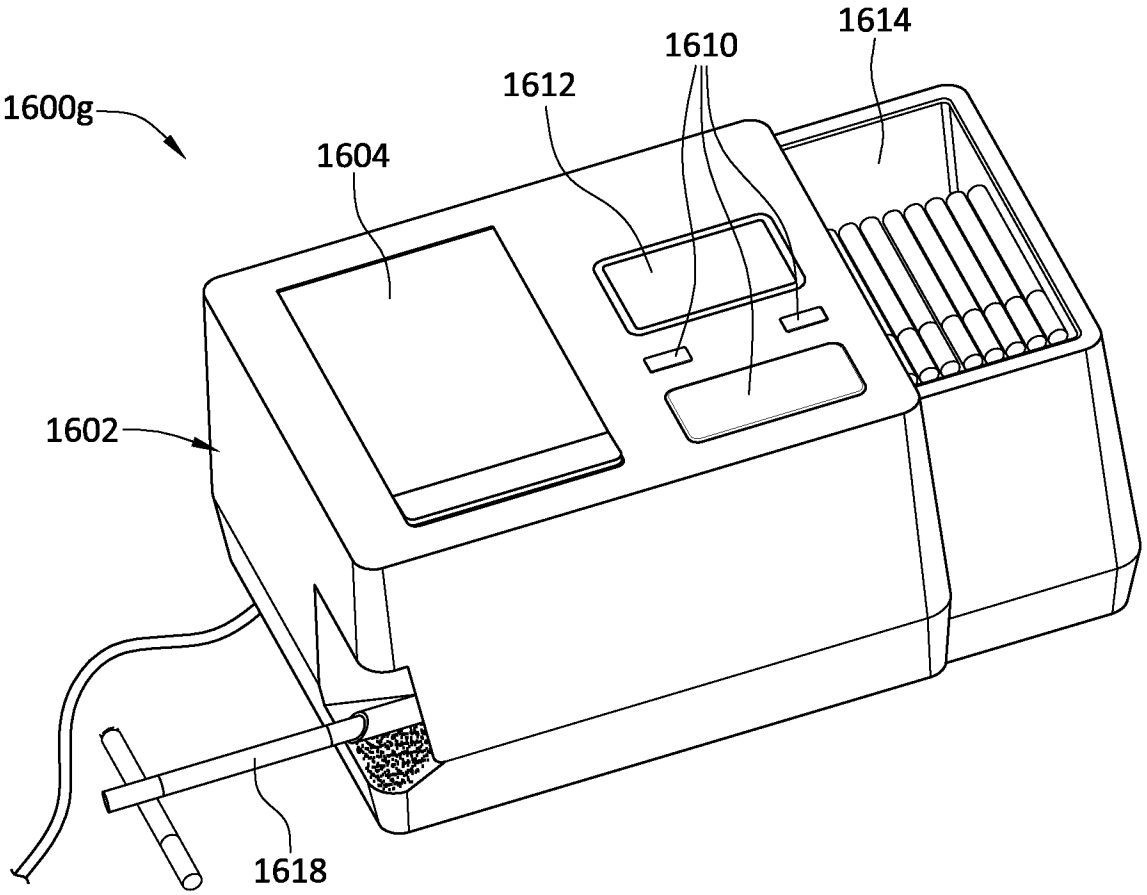
FIG. 16G is an example embodiment of a cigarette making machine image from a front perspective view.

FIG. 16G is an example embodiment of a cigarette making machine image 1600*g* from a front perspective view. As shown, the user has placed another cigarette casing 1618 in position on the machine for packing. In various embodiments, operation of cigarette making machines can be run multiple times in a row to make a plurality of cigarettes, depending on the amount of tobacco put into the machine. For example, the machine may be operable to compress or pack tobacco for cigarettes ten (10) times in a row with insertion into cigarette casing tubes. Additional attempts may cause the processor of the machine to pause operations and require user confirmation before running again.

As such, the user can make as many cigarettes desired, dependent upon the amount of tobacco in the hopper. A particular cycle, such as a ten (10) cycle limit may only apply to a packing operation. In other words, in some embodiments if a machine attempts to pack tobacco into a chamber by cycling fingers back and forth more than the preset number of times (e.g. 10 times), the operation of the machine may cease or otherwise stop and request or require user interaction (for example by pausing and displaying a message as described elsewhere herein).

As such, this may occur after a preset number of uses or operations in some embodiments. Additionally, this can also occur if tobacco becomes wedged between components, blocks them, or otherwise impedes normal machine performance or individual component functionality. In some embodiments, one or more component operation sensors can trigger a processor to cease operations if one or more components fails to properly function during an operation. At various points, one or more status messages can be displayed via user display requesting that user open chamber for hopper and loosen tobacco remaining in hopper chamber.

Figure 16H:
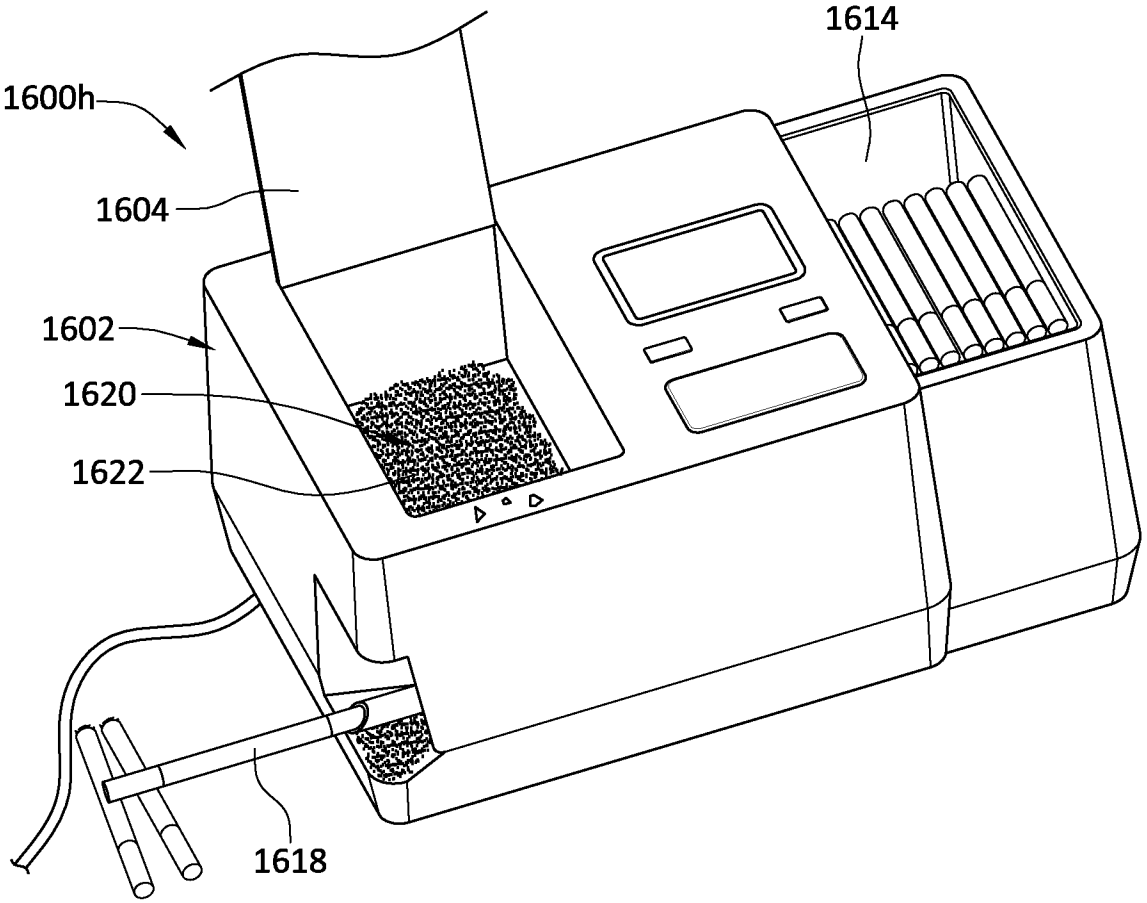
FIG. 16H is an example embodiment of a cigarette making machine image from a front perspective view.

FIG. 16H is an example embodiment of a cigarette making machine image 1600*h* from a front perspective view. As shown, the user can open door 1604 to access chamber 1620 and move or add tobacco 1622 as desired or required. Although useful, casing tubes 1618 need not be perfectly cylindrical in all embodiments for effective operation. As such, they may be slightly crimped, bent, or otherwise misshapen and machine may still be able to fill them with packed tobacco.

Figure 17:
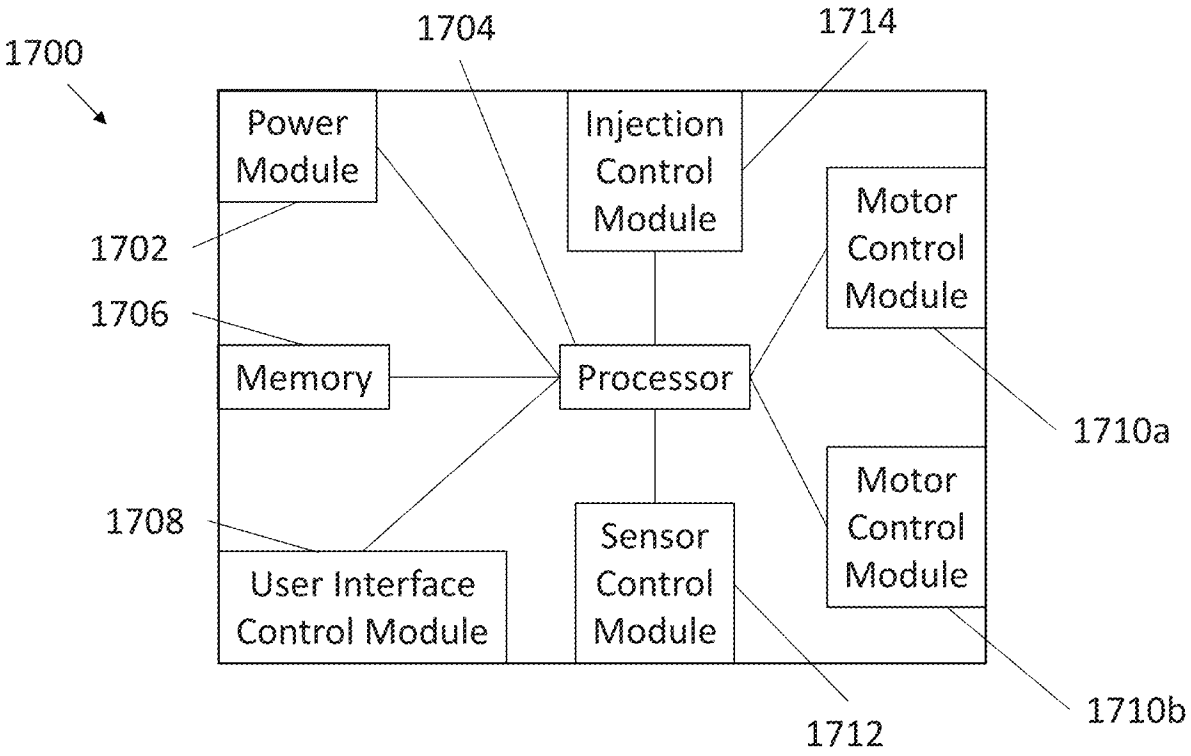
FIG. 17 is an example embodiment electrical control system diagram for a cigarette making machine.

FIG. 17 is an example embodiment electrical control system diagram 1700 for a cigarette making machine. As shown in the example embodiment, a power module 1702 can receive, monitor, and maintain effective electrical power when the machine is electrically coupled or connected to a source such as a battery or wall outlet. This can power a coupled processor 1704 that executes instructions stored in non-transitory computer readable memory 1706 that is coupled to processor 1704. These instructions can include program instructions that control the various operations of the machine and may include triggers, thresholds, or other operations.

Processor 1704 can also be coupled with user interface control module 1708, which controls messages and information that is displayed on a coupled user interface display. User interface control module 1708 can also receive commands that a user selects on one or more coupled user interface buttons or touchscreens. Also coupled to processor 1704 can be one or more motor control modules 1710*a*, 1710*b*. These can control operation of coupled motors, such as stepper motors that operate the various motors of the machine.

In some embodiments, there may be one, two, three, four, or other numbers of controlled motors in of the machine. In embodiments with four motors, one may be used for packing, one for packing adjustment, one for compressing, and one to drive a spoon into a cigarette tube. In various embodiments, only the packing adjustment motor may be a stepper motor. In various embodiments, the injection control module may be a separate part or component of the machine, but it need not be. It can be part of a processor module. One, some or all motors can also be communicatively coupled with one or more processors that control their function.

A sensor control module 1712 that is coupled to processor 1704 can monitor sensors within the machine that determine the state of one or more components of the machine. Once an adequate amount of tobacco has been packed as determined per the instructions and operations, injection of the tobacco into a cigarette tube can be controlled by an injection control module 1714 that is coupled to processor 1704.

It should be understood that the control system or control module described herein can be understood as a single electrical control module including a variety of components or a series of coupled modules or sub-modules. Modules can include their own memory and processors in some embodiments. Further, some embodiments can include additional system control components or modules, fewer system control components or modules, and combinations of system control components or modules. For example, an audio control module can be included in some embodiments that may have a speaker that recites preprogrammed messages or makes other sounds. Another example contemplated includes modules or other control of system indicator lights that can be operably coupled and show that the device is on, off, in use, plugged into a power source, needs attention, or others. As such, various alerts can be used in different contemplated embodiments. The various components, modules, and elements described or implemented can be those currently known in the art or later developed. Additionally, they can be mounted in a single location or in multiple locations, as appropriate. For example, they can be mounted or otherwise coupled in locations near motors, below or near buttons, or physically isolated within their own casings or chambers, with wires extending out to their operably coupled structures or components.

Figure 18:
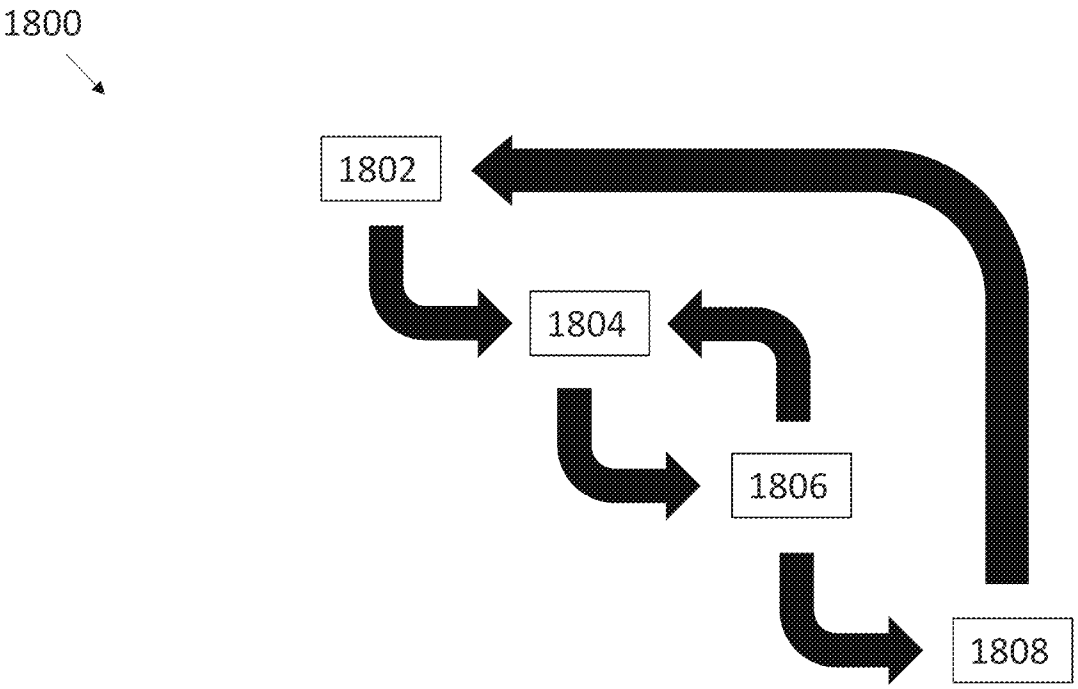
FIG. 18 shows an example embodiment device operation flowchart diagram.

FIG. 18 shows an example embodiment device operation flowchart diagram 1800. As shown in the example embodiment, in a first step 1802, a user can open a door of the device that is operably connected to a power source and insert tobacco into a receiving chamber or hopper before closing the door and applying a cigarette tube around a tobacco filling nozzle. As a second step 1804, the user can select a tobacco packing density via a user interface and select a start option. This can cause the machine to begin agitating and packing the tobacco before pushing it out through the nozzle and into the cigarette tube. A third step 1806 can include the user inspecting the cigarette to determine if it is adequately packed and repeating step 1804 by making any adjustments to packing density, if desired. If a maximum number of pre-programmed cycles have occurred, as programmed in non-transitory memory and monitored by a processor of the machine, in step 1808 the machine may display a message or otherwise indicate to the user that the user should return to step 1802. In some embodiments, this can be 3, 5, 10, or other numbers of cycles.

Figure 19A:
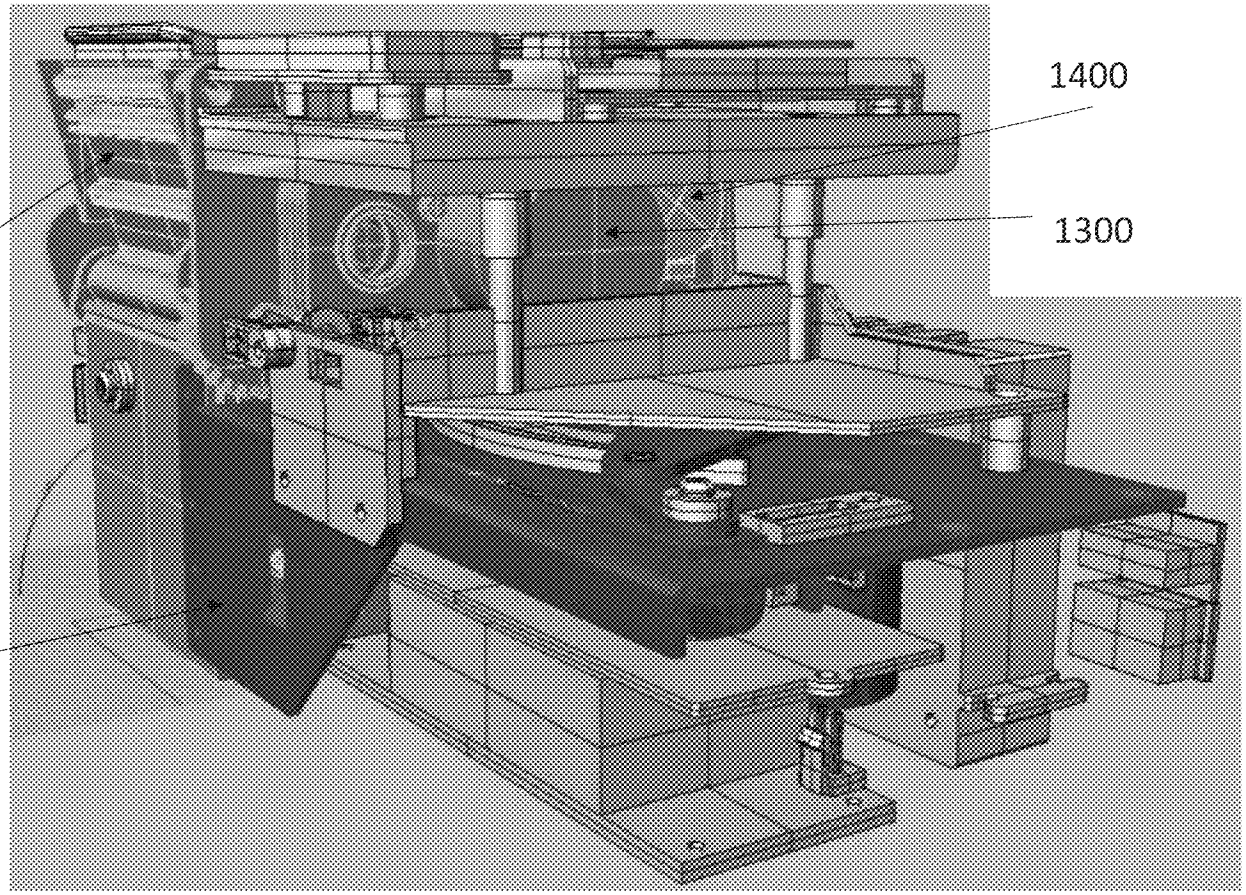
FIG. 19A shows an example embodiment diagram 1900*a* of a cigarette making machine diagram from a perspective view without a housing.

FIG. 19A shows an example embodiment diagram 1900*a* of a cigarette making machine diagram from a perspective view without a housing, including a spoon module 1902.

Figure 19B:
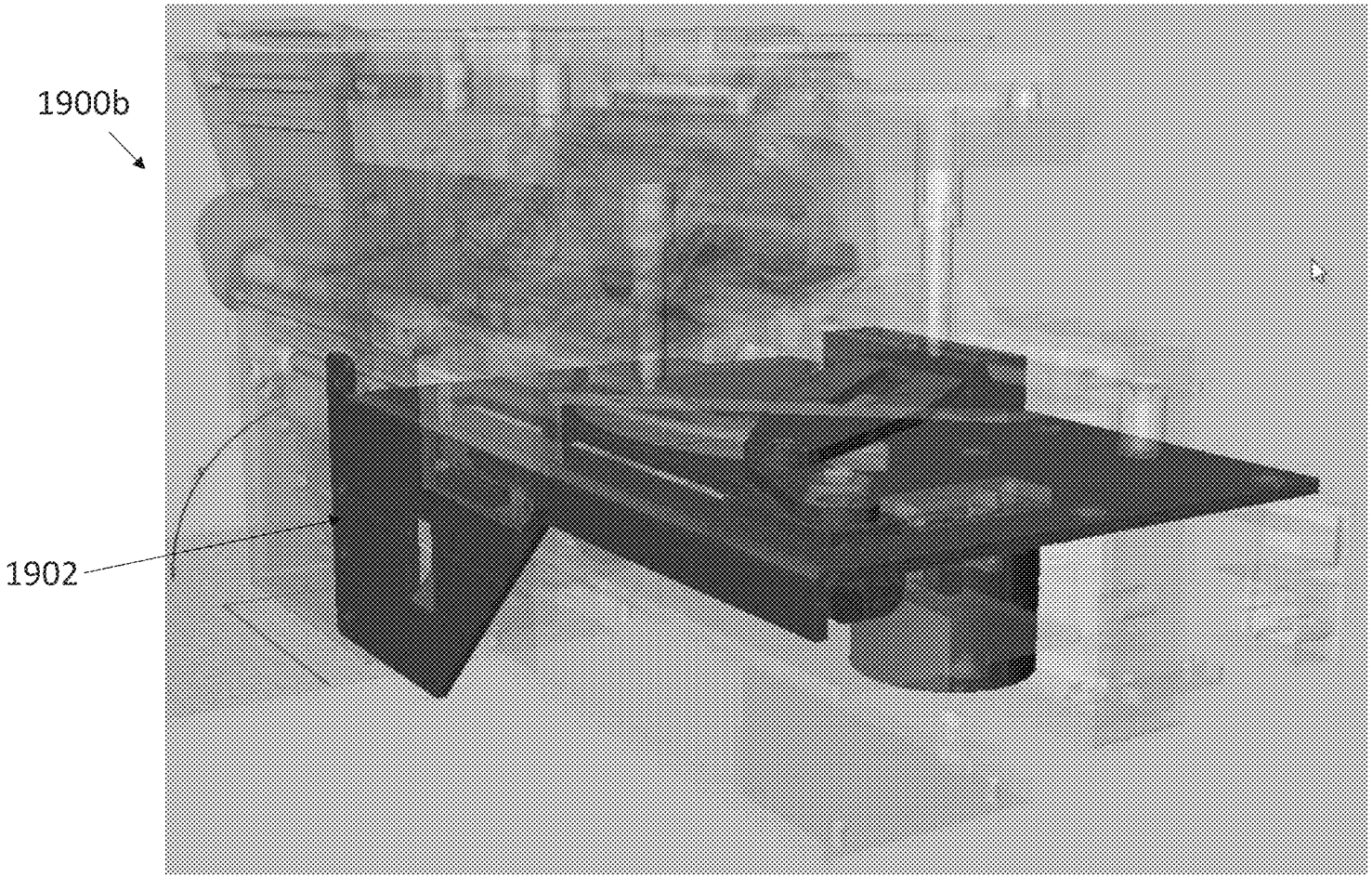
FIG. 19B shows an example embodiment diagram 1900*b* of a cigarette making machine diagram from a front perspective cutaway semi-transparent view.

FIG. 19B shows an example embodiment diagram 1900*b* of a cigarette making machine spoon module 1902 in a cigarette making machine from a front perspective cutaway semi-transparent view.

Figure 19C:
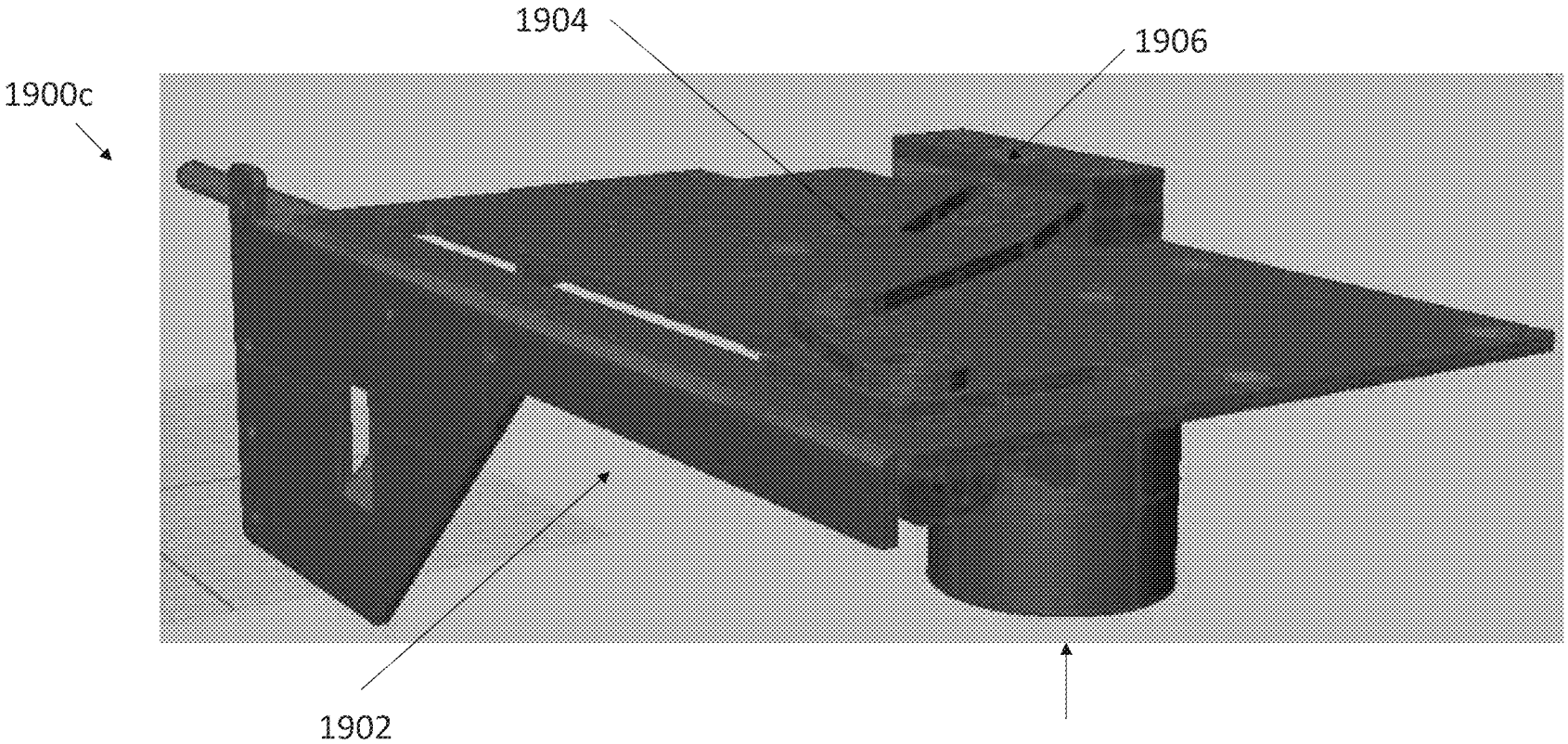
FIG. 19C shows an example embodiment diagram 1900*c* of a cigarette making machine spoon module perspective view.

FIG. 19C shows an example embodiment diagram 1900*c* of a cigarette making machine spoon module 1902 perspective view. As shown in the example embodiment, a powered motor 1916 can be coupled with and used to cause an arm 1904 to rotate about a pivot 1906 when controlled by a communicatively coupled processor. As such, it can move a spoon packer 1908 to push packed tobacco into a cigarette tube, as well as to withdraw spoon packer 1908 after this action has occurred.

Figure 19D:
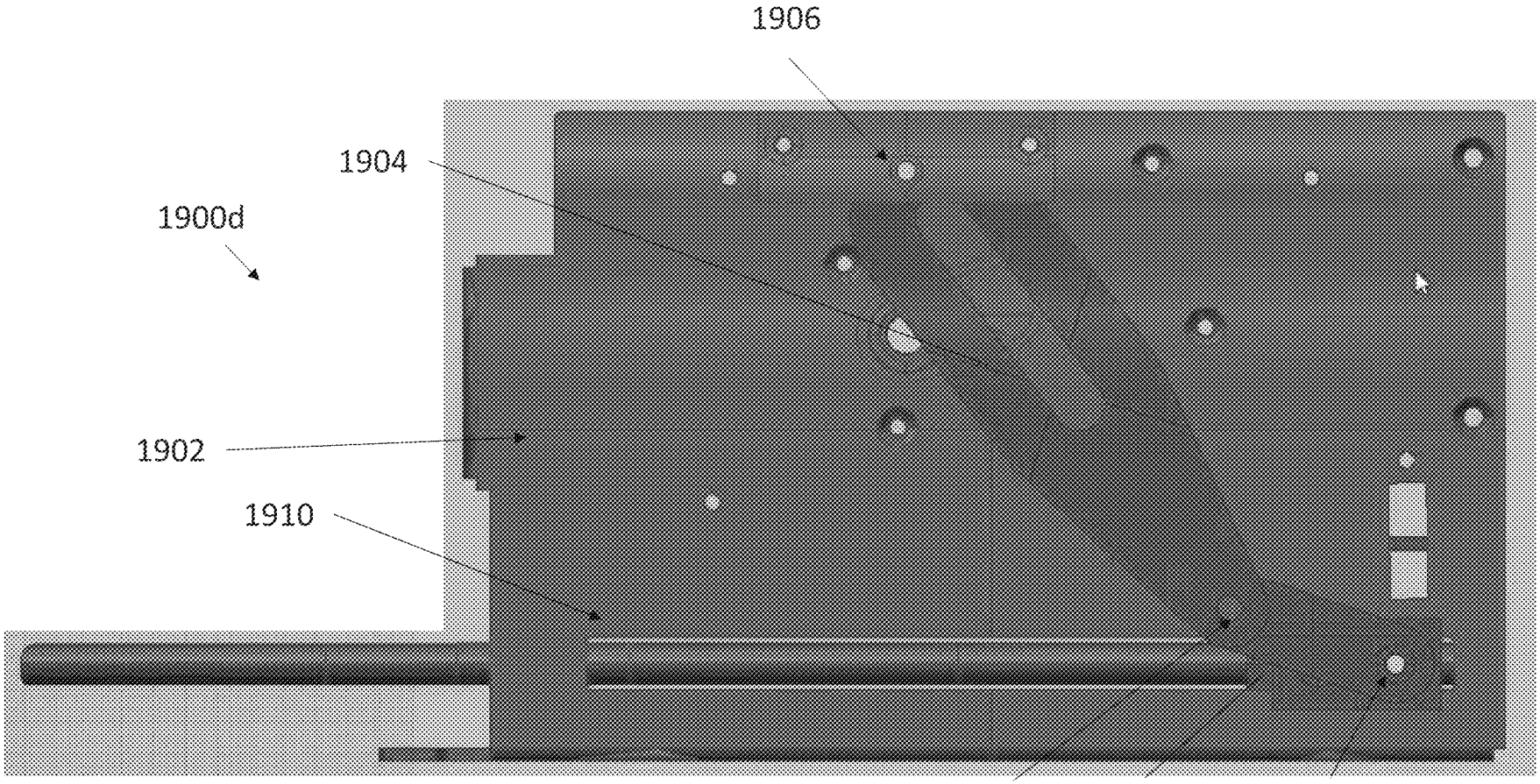
FIG. 19D shows an example embodiment diagram 1900*d* of a cigarette making machine spoon module view from a top-down perspective view.

FIG. 19D shows an example embodiment diagram 1900*d* of a cigarette making machine spoon module 1902 view from a top-down perspective view. As shown in the example embodiment, spoon module 1902 can include one or more arms 1904 that rotate about a pivot point 1906 at a proximal end of arm 1904. This rotation causes a spoon packer 1908 located at a distal end of arm 1904 to travel along a track or predefined path 1910 to push tobacco out of the machine and into a cigarette tube. Also shown is a pivot 1912 at distal end of arm 1904, allowing arm 1904 to rotate while maintaining a positional relationship of spoon packer 1908 with respect to track 1910. As shown, arm 1904 can be two or more arm sections with a separate pivot 1914 at a location somewhat near distal end of arm 1904. In some embodiments, this can be located in a different location of arm 1904.

In some embodiments, machine casings or body members can include one or more ports, doors, or access panels, such that users can open and close them to maintain internal components. For example, one or more ports can be provided that allow users to apply compressed air to clean optical sensors that may be obscured by tobacco dust after several machine use cycles have occurred. Materials for various components and structures described herein can be substituted or varied, as appropriate. As such, in some embodiments, various metals, plastics, and others can be used. These can include extruded aluminum, stamped steel, and many others, that are known in the art currently or later developed.

As used herein and in the appended claims, the singular forms "a", "an", and "the" include plural referents unless the context clearly dictates otherwise.

The publications discussed herein are provided solely for their disclosure prior to the filing date of the present application. Nothing herein is to be construed as an admission that the present disclosure is not entitled to antedate such publication by virtue of prior disclosure. Further, the dates of publication provided may be different from the actual publication dates which may need to be independently confirmed. Additionally, all publications discussed herein are hereby incorporated by reference in their entirety.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic) intervening entities) and the indirect coupling of two entities (with one or more non-negligible intervening entities). Where entities are shown as being directly coupled together, or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

The invention claimed is:

1. An automatic cigarette filling system for packing and filling cigarette tubes with tobacco, comprising:

a housing body, comprising:

a tobacco holding compartment to receive tobacco; and a nozzle to dispense packed tobacco from the tobacco holding compartment into a cigarette casing tube;

a packer module, located at least partially within the tobacco holding compartment, comprising:

a packing motor;

a packing platform coupled to the packing motor by a movable packer arm; and at least one finger slidably coupled with the packing platform to pack tobacco to a predetermined compression;

a dispensing spoon to dispense packed tobacco from the tobacco holding compartment via the nozzle;

a tobacco compression adjustment module, comprising:

a compressor adjustment motor; and a compressor adjustment arm operable to contact the packing platform, wherein actuating the compressor adjustment arm causes it to rotate about an axis and change position with respect to the packing platform; and a control system, comprising:

a user interface to receive input from a user; and an electrical control module comprising non-transitory computer readable memory and at least one processor that is operably coupled with the user interface and the packing motor, wherein, when connected to a power supply and upon receiving an input from the user, the electrical control module causes the packing motor to actuate the packer arm and thereby pack the tobacco to a predetermined compression using the at least one finger before dispensing it into a cigarette casing tube using the dispensing spoon, and upon receiving a compression adjustment user input, the electrical control module causes the compressor adjustment motor to actuate the compressor adjustment arm and thereby change the compression of the tobacco being packed.

2. The automatic cigarette filling system of claim 1, wherein there are three fingers, and wherein two of the three fingers are monitored by the electrical control module to pack the tobacco evenly.

3. The automatic cigarette filling system of claim 1, wherein the tobacco holding compartment is inverted at an angle of about seventy-five degrees downward from a horizontal plane; and the tobacco is compressed upwards into the tobacco holding compartment from the bottom up, such that the dispensing spoon is oriented above the bottom of the tobacco holding compartment to prevent the tobacco contained therein from falling behind the dispensing spoon.

4. The automatic cigarette filling system of claim 1, further comprising:

an agitator module, comprising:

an agitator arm; and an agitator platform coupled to the agitator arm, wherein the agitator arm is coupled to the packing motor and causes the agitator platform to agitate tobacco within the tobacco holding compartment when the packing motor is in operation.

5. The automatic cigarette filling system of claim 4, wherein the agitator module vibrates at a variable rate.

6. The automatic cigarette filling system of claim 4, wherein at least a portion of the agitator module does not prevent tobacco from falling within the tobacco holding compartment; and wherein the tobacco can at least partially adhere to at least a portion of the agitator module.

7. The automatic cigarette filling system of claim 4, wherein the agitator module is oriented such that it prevents tobacco from falling into portions of the system that may impede other cigarette packing and filling functions.

8. The automatic cigarette filling system of claim 4, wherein the agitator bar further guides tobacco to an area in front of the at least one finger and does not rely on gravity or vibration alone.

9. The automatic cigarette filling system of claim 1, further comprising:

a tobacco compressor module, comprising:

a compressor motor; and a compressor component having a channel, wherein the compressor motor is coupled to the electrical control module, such that, upon receiving a user input, the electrical control module causes the compressor motor to actuate the compressor component and thereby compress tobacco in the channel.

10. The automatic cigarette filling system of claim 9, wherein the dispensing spoon is operable to slide along the channel to dispense tobacco therefrom.

11. The automatic cigarette filling system of claim 9, wherein the dispensing spoon and is oriented such that a curved outer surface of the dispensing spoon is positioned above and parallel with the channel.

12. The automatic cigarette filling system of claim 1, wherein a density of cigarette packing is selected by the end user and electronically controlled by the at least one processor.

13. The automatic cigarette filling system of claim 1, wherein the dispensing spoon is oriented such that a curved outer surface of the dispensing spoon is positioned above the tobacco to be dispensed, thereby allowing gravity to help clear away any excess tobacco or other debris that may otherwise collect on the curved outer surface of the dispensing spoon and hamper operation thereof.

14. The automatic cigarette filling system of claim 1, further comprising:

a sensor, operable to detect at least one state of the packing module and coupled to the electrical control module, wherein the electrical control module ends a tobacco packing operation based on the sensor detecting the at least one state of the packing module is indicative of the packing module having packed tobacco to a predetermined compression during the tobacco packing operation.

15. The automatic cigarette filling system of claim 14, further comprising:

at least one additional sensor, operable to detect if the packer module is fully retracted, such that the at least one finger is not in the chamber when a tobacco compression adjustment module closes.

16. The automatic cigarette filling system of claim 15, wherein the at least one processor also monitors the least one additional sensor and counts a number of cycles of the packer module.

17. The automatic cigarette filling system of claim 16, wherein the sensor detecting the state of the packing module further comprises:

detecting a compression state of the at least one finger; and wherein the packing platform further comprises:

at least one platform hole in a surface of the packing platform, such that a finger surface is exposed through the platform hole, wherein detecting the compression state of the at least one finger further comprises the sensor detecting the compression state through the platform hole.

18. The automatic filling cigarette filling system of claim 17, wherein the at least one finger further comprises:

a finger hole through the finger that is positioned to align with the platform hole in at least one position when the finger has been slid within the packing platform, wherein detecting the compression state through the platform hole further comprises detecting the finger hole through the platform hole.

19. The automatic filling cigarette filling system of claim 18, wherein the packing platform further comprises a plurality of platform holes in a surface of the packing platform, wherein the packing module further comprises at least three packing fingers positioned along a length of tobacco to be packed, wherein at least two of the fingers each have a finger hole through the finger that is positioned to align with one of the plurality of platform holes in at least one position when the finger has been slid within the packing platform, and wherein the sensor is an optical sensor that is operable to detect light passing through each of the finger holes through the aligned platform holes.

20. The automatic cigarette filling system of claim 1, wherein the control system further comprises:

a user interface display, operable to display an operation state.

21. The automatic cigarette filling system of claim 1, wherein electrical control module is operable to cease operations after a pre-determined number of dispensing operations.

22. The automatic cigarette filling system of claim 1, wherein the platform is oriented at an angle with respect to a horizontal plane, such that tobacco is packed angularly downward in operation.

23. The automatic cigarette filling system of claim 1, wherein the housing body further comprises:

a cigarette tube casing holding chamber.

24. The automatic cigarette filling system of claim 1, wherein the at least one finger is coupled with a spring that impacts movement of the at least one finger with respect to the packing platform.

25. The automatic cigarette filling system of claim 24, further comprising:

a plurality of fingers, wherein each of the fingers is individually coupled with a spring and moves independently with respect to the other fingers.

* * * * *